US006364999B1

(12) United States Patent
Speaks et al.

(10) Patent No.: US 6,364,999 B1
(45) Date of Patent: Apr. 2, 2002

(54) PROCESS FOR PRODUCING A WOOD PULP HAVING REDUCED PITCH CONTENT AND PROCESS AND REDUCED VOC-EMISSIONS

(75) Inventors: Jerry R. Speaks, Union; Roger O. Campbell; Michael A. Veal, both of Federal Way, all of WA (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 09/256,526

(22) Filed: Feb. 24, 1999

Related U.S. Application Data

(63) Continuation-in-part of application No. 08/939,788, filed on Sep. 29, 1997, now abandoned, which is a continuation of application No. 08/578,987, filed on Dec. 27, 1995, now abandoned, application No. 09/256,526, and a continuation-in-part of application No. 08/902,875, filed on Jul. 30, 1997, now abandoned, which is a continuation of application No. 08/579,569, filed on Dec. 27, 1995, now abandoned, application No. 09/256,526, and a continuation-in-part of application No. 08/902,876, filed on Jul. 30, 1997, now abandoned, which is a continuation of application No. 08/578,990, filed on Dec. 27, 1995, now abandoned.

(51) Int. Cl.[7] ..... D21B 1/16
(52) U.S. Cl. ..... 162/25; 162/28; 162/29; 162/55; 162/72; 162/77; 162/DIG. 4
(58) Field of Search ..... 162/25, 55, 72, 162/77, 20, 52, DIG. 4, 28, 24, 29, 40

(56) References Cited

U.S. PATENT DOCUMENTS

| | | | |
|---|---|---|---|
| 1,919,623 | A | 7/1933 | Dreyfus |
| 2,022,654 | A | 12/1935 | Dreyfus |
| 2,106,797 | A | 2/1938 | Dreyfus |
| 2,538,457 | A | 1/1951 | Hudson |
| 2,840,459 | A | 6/1958 | Karnofsky |
| 3,635,789 | A | 1/1972 | Green, Jr. |
| 3,963,560 | A | 6/1976 | Mestetsky et al. |

(List continued on next page.)

FOREIGN PATENT DOCUMENTS

| | | |
|---|---|---|
| CA | 1105660 | 7/1981 |
| DE | 112 449 C | 6/1900 |
| DE | 2307477 | 8/1973 |
| FR | 454 137 A | 6/1913 |
| FR | 2619837 | 3/1989 |
| JP | 0163-959 | 1/1985 |
| WO | WO 9636765 | 11/1996 |

OTHER PUBLICATIONS

"Paper Chemistry", Blackie Academic & International, Glasgow XP002053483, edited by J.C. Roberts; pp. 257–259.

(List continued on next page.)

*Primary Examiner*—Steve Alvo
(74) *Attorney, Agent, or Firm*—Christensen O'Connor Johnson Kindness PLLC

(57) ABSTRACT

Paper and absorbent products having reduced pitch content and enhanced properties, including increased tensile index, tear index, burst index, Scott Bond, smoothness, and stiffness. Further, pulps of the invention, although having slightly reduced brightness, are more responsive to bleach chemicals thereby permitting the use of less chemicals to achieve a specific brightness. The products are produced by a process that includes extracting wood particulates with a solvent for naturally-occurring volatile organic compounds and pitch. The extracted wood particulates are then pulped and formed into paper and absorbent products with enhanced properties. Due to the extraction of volatile organic compounds, the pulping and paperforming stages of the process are substantially free of emissions of volatile organic compounds that occur naturally in wood. Moreover, the extraction of pitch reduces or eliminates pitch fouling of equipment and permits the production of paper products of enhanced qualities.

15 Claims, 9 Drawing Sheets

U.S. PATENT DOCUMENTS

| | | | |
|---|---|---|---|
| 4,029,515 | A | 6/1977 | Kiminki et al. |
| 4,100,016 | A | 7/1978 | Diebold et al. |
| 4,145,345 | A | 3/1979 | Beemsterboer et al. |
| 4,308,200 | A | 12/1981 | Fremont |
| 4,313,011 | A | 1/1982 | Weil et al. |
| 4,324,710 | A | 4/1982 | Davis et al. |
| 4,409,032 | A | 10/1983 | Paszner et al. |
| 4,446,651 | A | 5/1984 | Spitz, Jr. et al. |
| 4,470,851 | A | 9/1984 | Paszner et al. |
| 4,496,426 | A | 1/1985 | Baumeister et al. |
| 4,515,713 | A | 5/1985 | Wideman et al. |
| 4,520,105 | A | 5/1985 | Sinner et al. |
| 4,548,675 | A | 10/1985 | Gordy |
| 4,563,273 | A | 1/1986 | Gessler |
| 4,594,130 | A | 6/1986 | Chang et al. |
| 4,595,507 | A | 6/1986 | Chang et al. |
| 4,599,190 | A | 7/1986 | Maloney |
| 4,617,126 | A | 10/1986 | Funk et al. |
| 4,684,740 | A | 8/1987 | Higuchi et al. |
| 4,764,596 | A | 8/1988 | Lora et al. |
| 4,810,510 | A | 3/1989 | Lever et al. |
| 4,919,754 | A | 4/1990 | Mollett et al. |
| 4,941,944 | A | 7/1990 | Chang |
| 4,950,751 | A | 8/1990 | DeWitt |
| 4,996,258 | A | 2/1991 | Wideman et al. |
| 5,010,156 | A | 4/1991 | Cook et al. |
| 5,073,234 | A | 12/1991 | Mollett et al. |
| 5,134,023 | A | 7/1992 | Hsu |
| 5,176,796 | A | 1/1993 | Irie et al. |
| 5,221,357 | A | 6/1993 | Brink |
| 5,252,183 | A | 10/1993 | Shaban et al. |
| 5,259,969 | A | 11/1993 | Srivatsa et al. |
| 5,362,362 | A | 11/1994 | Cunningham et al. |
| 5,366,558 | A | 11/1994 | Brink |
| 5,370,770 | A | 12/1994 | Johnson et al. |
| 5,389,200 | A | 2/1995 | Cody et al. |
| 5,413,675 | A | 5/1995 | Ikonomou et al. |
| 5,431,729 | A | 7/1995 | Hegge |
| 5,698,667 | A | 12/1997 | Speaks et al. |

OTHER PUBLICATIONS

T. Chen et al., "Using solid–phase extraction to assess why aspen causes more pitch problems than softwoods in kraft pulping", *Wood and Pulping Chemistry*, vol. 78, No. 10, Oct. 1995, Tappi Journal, pp. 143–149.

J. Brandal et al., "The Influence of Extractives in Groundwood Pulp on Fibre Bonding", *Pulp and Paper Magazine of Canada*, Oct., 1966, pp. T–431–T–435.

See abstract at Database WPI, Week 9618, Derwent Publications Ltd., London, GB; AN 96–178342, XP002057832 & RU 2 041 814 C (Perm Techn Res Inst), Aug. 20, 1995.

See abstract at Database WPI, Week 8503, Derwent Publications Ltd., London, GB; AN 84–290264, XP002057833 & ES 8 404 908 A (De Pedro A M), Nov. 30, 1984.

Chemical Abstracts, vol. 79, No. 2, Jul. 16, 1973, Columbus, OH, USA; abstract No. 7016: "Effect of some extractive substances of wood on properties of lignocarbohydrate plastics," XP002057831; see abstract & Kholomeev V.P. et al.; Tr. Ural Lesotekh. Inst., vol. 26, 1972, pp. 35–38.

PROCESS FOR PRODUCING A WOOD PULP HAVING REDUCED PITCH CONTENT AND PROCESS AND REDUCED VOC-EMISSIONS

RELATED APPLICATIONS

This application is a continuation-in-part of prior application Ser. No. 08/939,788, filed Sep. 29, 1997, now abandoned, which is a file wrapper continuation of prior application Ser. No. 08/578,987, filed Dec. 27, 1995, now abandoned, a continuation-in-part-of prior application Ser. No. 08/902,875, filed Jul. 30, 1997, now abandoned, which is a file wrapper continuation of prior application Ser. No. 08/579,569, filed Dec. 27, 1995 now abandoned; and a continuation-in-part of Ser. No. 08/902,876, filed Jul. 30, 1997, now abandoned, which is a file wrapper continuation-of prior application Ser. No. 08/578,990, filed Dec. 27, 1995, now abandoned.

FIELD OF THE INVENTION

The invention relates to a fibrous cellulosic pulp of reduced pitch and volatile organic compound content from which paper and absorbent products of reduced pitch content are produced. More particularly, according to the invention, wood particulates are subjected to a solvent extraction process that removes pitch, as well as other wood extractives, from the wood particulates that are then subjected to a pulping process to produce pulps of reduced pitch content. These pulps are processed into paper and absorbent products of reduced pitch content. The invention also relates to chemical and mechanical wood pulping processes for wood particulates that are virtually free of volatile organic compound emissions.

BACKGROUND OF THE INVENTION

As a preliminary matter, wood can be viewed as consisting of two major components, carbohydrates and lignin. Other components constitute a minor part of the wood and manifest as intercellular material, and extraneous substances that are related to the growth of the cells of the tree. The cell walls of the wood are composed of polysaccharides, the chief of which is cellulose. Lignin, on the other hand, is an amorphous substance, partly aromatic in nature, that has been called a "cementing material" or an "encrusting substance." It is insoluble in water and in most common organic solvents. It is also insoluble in acids, but undergoes condensation reactions in the presence of strong mineral acids. Lignin is partly soluble in alkline solutions and is readily attacked and solubilized by oxidizing agents.

The extraneous substances of wood are deposited as cells grow, or after they reach maturity. Most of these substances are relatively simple compounds, having a low molecular weight. These low molecular weight substances include pectins, proteins, and like substances that are soluble in water or neutral organic solvents. The extraneous substances also include "wood extractives" that include pitch and volatile organic compounds. These naturally-occuring wood extractives are found in both resin canals within the structure of the wood, as well as within the parenchyma cells of the wood.

In general, wood extractives may be divided into a higher molecular weight, higher boiling point fraction, commonly known as "pitch", and a lower molecular weight, lower boiling point fraction that falls within the definition of "volatile organic compounds." The United States Environmental Protection Agency (EPA) has determined that volatile organic compounds (VOCs) pose an environmental hazard when they are released into the atmosphere. These VOCs are defined in 40 CFR Part 51(s) as "any compound of carbon, excluding carbon monoxide, carbon dioxide, carbonic acid, metallic carbides or carbonates, and ammonium carbonate, which participates in atmospheric photochemical reactions." Typically these are volatile low molecular weight organic compounds. The EPA has promulgated regulations limiting the quantity of VOCs that a manufacturing facility may release into the atmosphere.

There is no equivalent regulation regarding pitch. However, pitch poses processing and product quality issues in the pulp and paper industry. In pulp mills, the pitch separates from the cellulosic fibers to form a colloid-like suspension that gradually deposits to build up a scale within the process equipment and ducting of the mill. Ultimately, the pulp mill must be shut down so that this pitch scale may be manually removed. In an effort to reduce the frequency of shut-downs to remove pitch scale, pitch scale control chemicals, such as sodium aluminate and alum, are added to the pulping process. While this strategy is partially successful in that it alleviates the equipment fouling problem, it does not eliminate all the problems caused by pitch. Indeed, the addition of scale control chemicals also poses a waste disposal problem since these chemicals are present in the process water. Although this water is recycled, a portion must be treated and disposed of This, of course, entails additional operating costs for treatment chemicals, labor and facilities.

Colloidal pitch in the process water, as well as some pitch adhering to pulp fibers, cause significant equipment fouling problems in pulp dryers and papermaking machines. In these capital intensive high speed machines, the pulp is formed into continuous webs on high speed fabrics, dewatered, and dried. During these processes, pitch is gradually deposited onto the rolls and machine "clothing" of the papermaking machines to form a tacky, gummy surface deposit. This ultimately results in reduced product quality and machine efficiency. Removing the gum can require shutting down the papermaking machine, chemical cleaning or removing the clothing, and cleaning all affected surfaces. This results not only in cleaning costs and paper wastage losses, but also in significant machine downtime with consequent economic loss. Other methods of treatment include the use of continuous cleaning chemicals and equipment. Some of these chemicals may contribute to the release of VOCs and compositions with high biological oxygen demand (BOD) and/or high chemical oxygen demand (COD) into the environment.

Finally, pitch present in the pulp causes a loss of brightness in paper and absorbent products produced from the pulp. To overcome this, the pulp must be bleached, at an added chemical treatment cost.

The release of VOCs into the atmosphere is also a long-standing problem in the pulp and paper industry. To produce boards (oriented strand board, particle, veneer) composite wood products, and paper and pulp products, raw logs or wood fibrous material must be reduced to wood chips, flakes or sawdust. These wood particulates are then further processed, either by bonding together with a suitable glue to make board products, or undergoing pulping and forming processes to produce a variety of papers and absorbent products. However, the processing of logs into wood particulates, and thence into finished products, poses several challenges. Some of these arise from the nature of wood, namely, that it includes not only cellulosic fibers and lignin but also "wood extractives," as discussed above. VOCs occur naturally in timber and the processing of timber into wood particulates facilitates the migration or diffusion of VOCs to chip surfaces from which the compounds vaporize into the surrounding atmosphere. As a practical matter, since the industry requires a large inventory of wood chips for processing into board products and as feedstock in the pulp and paper processes, significant amounts of VOCs are released into the atmosphere from wood chip storage piles. Further, VOCs are also released into the atmosphere during the processing of the wood chips into paper and pulp products.

The distribution of pitch and VOCs from raw wood into the environment and into products may be more easily understood with reference to FIG. 1. As shown, logs 5' are processed into chips in chip mill 10' releasing VOCs 2' to the atmosphere. The chips are stored in mounds 7' that continue to release VOCs 4' to the atmosphere. Chips, naturally containing chemical compounds that may produce from about 1 to about 6 wt. % VOCs, for example, are processed in a pulp mill 12', which can be a mechanical, thermo-mechanical or a chemical pulp mill, to produce cellulosic and fibrous pulps. During this pulping process, cellulosic fibers of the wood are separated from each other thereby allowing entrapped VOCs to diffuse to fiber surfaces and vaporize into the surrounding atmosphere. However, the higher boiling point pitch material remains in the fibers. Treatment chemicals fix a portion of the pitch to the fibers to reduce the rate of mill equipment fouling. The cellulosic pulp produced may be bleached, such as by a chlorine bleaching process, and is then formed into a continuous web and dried on a pulp drier or paper machine 14'. During these processes, a further significant amount of VOCs is released into the atmosphere. The combined chipping, crushing, pulping, and paper or absorbent product making processes release about one-third of the total natural extractives in the wood into the atmosphere (shown by arrows 2', 4', 6', and 8') as VOCs, and another one-third into effluent water (arrows 20', 22' and 24'). The papermill product 15', such as newsprint, writing paper, or absorbent products, includes the residual of about one-third of the total amount of extractives, mainly pitch with low amounts of VOCs.

The amount of extractives, and VOCs, in wood varies depending upon several factors including wood species, age, and season of felling. However, chips may be expected to contain from 1 to 6 wt. % VOCs. While the percentage of VOCs released into the atmosphere may appear small, relative to wood particulate mass, the actual quantity is nevertheless very significant. For example, a facility may process about 1,000–6,000 tons of wood chips per day. A 6,000 ton per day facility could, therefore, emit as much as 120 tons of VOCs daily. The EPA proposes limiting the amount of VOCs that any wood chip processing facility releases into the atmosphere by regulations requiring permits. Since a wood chip processing facility represents a significant capital investment, operators must take steps to limit VOC emissions while at the same time ensuring that processing equipment operate at or near full capacity for an adequate return on investment. To date, methods for limiting the quantity of VOC emissions have focused on enclosing the atmosphere surrounding any wood chip process that may release VOCs and subjecting air within the enclosure to treatment for the removal of VOCs, before release of the air into the environment. These methods require expensive equipment including large hoods to enclose equipment, fans and ducts for transporting air containing VOCs, condensers for condensing VOCs and incinerators for combusting VOCs. Such equipment not only poses capital cost demands, but also requires operating and maintenance expenses.

The higher boiling portion of the wood extractives, the pitch, presents separate and different problems in processes for treating wood chips to produce paper and pulp products. In a mechanical pulp mill, relying on heat and mechanical stresses to separate wood chips into fibers, a portion of the pitch vaporizes and later condenses to form a pitch scale that includes a gummy, sticky deposit that fouls the pulping equipment. Ultimately, the fouling reaches a point that a shut down of the mill is required so that the pitch scale may be manually and/or chemically removed. Similarly, in the chemical pulping mill some of the pitch separates from the cellulosic fibers to form a colloidal-type suspension. Pitch is deposited from this suspension and gradually builds up as a scale within the process equipment and ducting of the mill. Ultimately, the pulp mill must be shut down so that this pitch scale may be manually or chemically removed. To reduce the frequency of shut-downs to remove pitch scale, additives can be added to the pulping process, such as sodium aluminate and alum in the mechanical pulping process, in an effort to prevent pitch deposition onto equipment surfaces. While this reduces the equipment fouling problem, it does not eliminate the problem. The chemical additives also pose a waste disposal problem since these chemicals are present in the process water. Although this water is recycled, a portion must be treated and disposed of This, of course, entails additional operating costs for treatment chemicals, labor and facilities.

In the mechanical pulping process, cellulosic fibers produced in a mechanical fiberizing step is combined with sufficient water to produce a pumpable slurry ("stock") of fibers that can then be transported to additional processing equipment (screens, cleaners, and bleaching facilities). The stock is then formed into paper or other absorbent products or a useful pulp. However, these fibers, and water used to transport the fibers, contain pitch that was released from the wood chips during the fiberizing process. This pitch causes significant equipment fouling problems in papermaking machines where the stock is formed into a continuous web on high speed fabrics used to dewater the stock. The web is then dried to complete the papermaking process. During these process steps, colloidal pitch carried in the slurry gradually deposits onto the rolls and machine "clothing" of the papermaking machine to form a tacky, gummy surface deposit. This deposit ultimately results in reduced pulp or product quality and machine efficiency. Removing the gummy deposit can require shutting down the papermaking machine, chemical cleaning of the clothing, often requiring removing of the clothing, and cleaning all other affected surfaces. This results not only in cleaning costs and paper wastage losses, but also in significant machine down time. Other methods of treatment include the use of continuous cleaning chemicals and equipment. However, some of these chemicals may contribute to the release of VOCs and compositions with high biological oxygen demand (BOD) and/or high chemical oxygen demand (COD) into the environment. Similar fouling problems due to the presence of residual pitch in the white water (recycled water) of chemical pulping plants causes significant equipment fouling during pulp processing.

There exists a need to reduce the pitch content of pulp and paper fiber to allow the production of paper of improved strength and brightness. However, this reduction in pitch content must be achieved without significant reduction in the yield of pulp from wood. Otherwise, economic losses due to the decline in yield may not be offset by gains from improved product quality. Further, there exists a need to reduce the pitch content of pulp in order to reduce or eliminate the formation of tacky, gummy surface deposits on clothing of pulp or papermaking machines that adversely affect machine efficiency. There is also a need to eliminate VOC emissions from papermaking processes into the environment.

Further, there exists a need to reduce or eliminate the release into the environment of volatile organic compounds from mechanical wood pulping operations that convert wood chips, or other wood particulates, into wood pulp for subsequent processing into product such as paper and absorbent consumer products. Further, there also exists a need to reduce or eliminate the down time, and to reduce the chemical costs, of wood pulping facilities and paper and absorbent product making machines that is caused by the fouling of equipment by pitch that occurs naturally in wood.

Additionally, there exists a need to reduce or eliminate the release into the environment of volatile organic compounds, that occur naturally in wood, from chemical wood pulping operations. There also exists a need to reduce or eliminate the downtime of chemical wood pulping facilities caused by fouling of equipment by pitch that occurs naturally in wood.

SUMMARY OF THE INVENTION

In a first aspect, the invention provides paper and absorbent products made from wood pulps that have reduced pitch content and a process for producing these products. The invention provides a paper pulp of superior strength properties and optical properties, without loss of yield. Further, the invention includes a process that includes a wood pulping stage and a paper-forming stage that have substantially reduced emissions of naturally-occurring volatile organic compounds from wood. Pulps manufactured in accordance with the invention have a reduced pitch content. These reduced pitch content pulps substantially reduce or eleminate the formation of gummy, tacky deposits on papermaking machines during the processing of the pulps into paper or absorbent products.

According to a first aspect of the invention, wood particulates are contacted with a solvent for pitch and VOCs. The solvent extracts a substantial portion of both the pitch and VOCs from the particulates, and is separated as a "miscella" from the leached wood particulates. The extraction removes from about 50 to about 100 wt. % of the VOCs present in the raw wood particulates. Further, the process also removes from about 40 to about 80 wt. % of the pitch. The miscella, including solvent, water, VOCs, and pitch, is subjected to a separation process that reclaims solvent for reuse in the extraction process. The leached wood particulates, now having substantially reduced pitch and VOC contents, are then subjected to chemical or mechanical processes for the production of pulp, with significantly reduced emissions of VOCs. The pulps, having a reduced pitch content, are then formed into paper and absorbent products on papermaking machines, without the attendant pitch deposits that occur in prior art.

The first aspect of the invention provides a superior paper product that is formed from a mass of cellulosic fibers and that has a pitch content at least about 40% less than an expected pitch content, based on the naturally-occurring pitch content of its wood of origin. The product has superior burst index tear index, tensile index, Scott Bond, Sheffield Smoothness, stiffness and stretch. The product is also of higher density and porosity (seconds/100 ml). Finally, the product is more oleophobic (i.e., less attractive to oils), but can be produced to a predictable degree of oleophilicity. This facilitates subsequent chemical treatment to control oleophilicity to a desired level for particular products. Such products of specified oleophilicity are advantageous in certain printing applications, where the inks are oil-based or oleophilic.

The first aspect of the invention solves long-standing problems of VOC emissions and pitch fouling of equipment by removing pitch from the wood particulates before the pulping step. The first aspect of the invention allows the virtual elimination of pitch scale formation in pulp mills, and on pulp and papermaking machines. This results in significant improvements in mill efficiencies and reduced use of pitch treatment chemicals, in pulp processes and process water, that pose a disposal problem. By providing wood-containing (commonly known as "mechanical") pulps of superior optical properties (i.e. appearance), the first aspect of the invention reduces the demand for chemical bleaches. Additionally, the first aspect of the invention reduces the BOD and COD of process water, alleviating the need for post environmental treatment.

In a second aspect, the invention provides a mechanical process for fiberizing wood particulates, that substantially reduces the emission of volatile organic compounds into the environment while maintaining the yield of pulp. Moreover, pulp produced from the mechanical process has a reduced pitch content. Consequently, pitch fouling of the mechanical pulping process equipment, and other pulp processing, drying, and papermaking process equipment, is substantially reduced or eliminated. As a result of the reduced pitch content of the pulp, the invention also allows the production of a pulp of superior strength, brightness, and visual properties.

In the mechanical pulping process of the invention, the wood particulate feedstock sent to the refiners is pre-extracted to remove a substantial proportion of the volatile organic compounds from the wood particulates. As a result, the invention substantially reduces or eliminates the emission of volatile organic compounds from chip pulping, and subsequent pulp and paper forming and drying processes. The extraction stage may also substantially reduce the amount of pitch in wood particulates, depending upon the solvent selected, thereby reducing or substantially eliminating pitch fouling of equipment in the pulp processing and subsequent papermaking processes. This invention also significantly reduces chemical costs, such as defoamer, alum, sodium aluminate and caustic costs, required to deal with pitch deposited during the pulping and bleaching operations. Further, as a result of pitch removal, the process of the invention allows the production of a mechanical pulp of superior strength and optical properties.

In the extraction stage, according to the second aspect of the invention, wood particulates are contacted with a solvent for dissolving VOCs and pitch. The extraction step of the invention removes from about 50 to about 100 wt. % of the VOCs present in the raw wood particulates. Further, the extraction step also removes from about 40 to about 80 wt. of the pitch. The solvent extracts a substantial proportion of the VOCs and pitch from the particulates, and is separated as a "miscella" from the leached wood particulates. The miscelia, including solvent, water, VOCs, and pitch, is subjected to a separation process that recovers the solvent for reuse, a pitch product that may be sold as a chemical feedstock or used as a fuel, and a VOC product. The leached wood particulates, now having substantially reduced VOC and pitch contents, are then subjected to a mechanical pulping process for the production of pulp for use in making paper and absorbent products, with significantly reduced emissions of VOCs.

In the practice of the second aspect of the invention, the solvent extracted wood particulates are charged to a mechanical pulp mill where the particulates are subjected to mechanical stresses (that also generate heat) to separate the individual wood fibers of the particulates from each other to produce a fibrous, cellulosic product. During this process VOC emissions are significantly reduced as compared to prior art processes. When combined with sufficient water, the fibrous product forms a pulp that is pumpable. The mechanical pulping process of the invention produces a pulp that has a reduced pitch content, and superior brightness and strength, as a result.

The second aspect of the invention solves a long-standing environmental problem by virtually eliminating the release of VOCs into the atmosphere in mechanical pulp processes. The invention also allows the virtual elimination of pitch scale formation in pulp mills, and on papermaking machines. By removing pitch from the wood particulates before processing, the invention permits the realization of significant cost savings in pulp mills and subsequent papermaking machine operations. Among these benefits are improvements in mill efficiencies.

In a third aspect, the invention provides a chemical wood pulping process of reduced VOC emissions and chemical pulps of reduced pitch content that have superior physical properties. In accordance with the third aspect of the invention, wood particulates are pretreated in a solvent extraction process to remove a significant proportion of the naturally-occuring VOCs and a significant proportion of the naturally-occurring pitch of the particulates. Thus, when the solvent extracted wood particulates undergo chemical pulping, the process has significantly reduced VOC emissions, and the pulp product has a reduced pitch content. Moreover, due to the reduced pitch content of the wood particulates charged to the chemical pulping process, pitch fouling of wood pulping equipment, and subsequent pulp processing equipment, is substantially reduced or eliminated.

According to the third aspect of the invention, chemical pulping processes are charged with wood particulates that have been extracted with a solvent for VOCs and pitch. The solvent extracts a significant portion of the VOCs and pitch from the particulates. Usually, the extraction removes from about 50 to about 100 wt. % of the VOCs present in the raw wood particulates, depending upon the solvent and the severity of the extraction. Further, the process also removes from about 40 to about 80 wt. % of the pitch. The leached wood particulates are then subjected to chemical processes for the production of pulp with significantly reduced emissions of VOCs.

The third aspect of the invention solves a long-standing environmental problem by reducing or virtually eliminating wood particulate release of VOCs into the atmosphere in chemical pulping operations. Also, by removing all, or a significant proportion of, the naturally-occurring pitch from wood particulates before processing, the invention permits the realization of significant cost savings in pulp mills and papermaking machine operations by virtually eliminating costs associated with pitch fouling. This results in significant improvements in mill efficiencies. This invention also permits reduced use of pitch treatment chemicals, in pulp processes and process water, that pose a disposal problem. Further, the removal of pitch from wood particulates provides brighter wood particulates that resist age-darkening. This allows the production of pulp of higher brightness, thereby reducing the demand for chemical bleaches. Moreover, the pulps of the invention are less oleophilic but can be produced to a predictable oleophilicity. The use of predetermined amounts of a chemical additive can then produce a desired level of oleophilicity in the end product—a useful feature when oil-based inks are used to print on paper produced from the pulp.

Additionally, the BOD and COD of process water are reduced, alleviating the need for post-treatment for environmental purposes. Also, the process reduces the volume of black liquor produced per ton of pulp thereby debottlenecking liquor recovery systems, in particular the recovery boiler, while also allowing energy savings.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 3A is a schematic diagram of an embodiment of a chip extractor of the invention;

DETAILED DESCRIPTION OF THE PREFERRED EMBODIMENT

Figure 1:
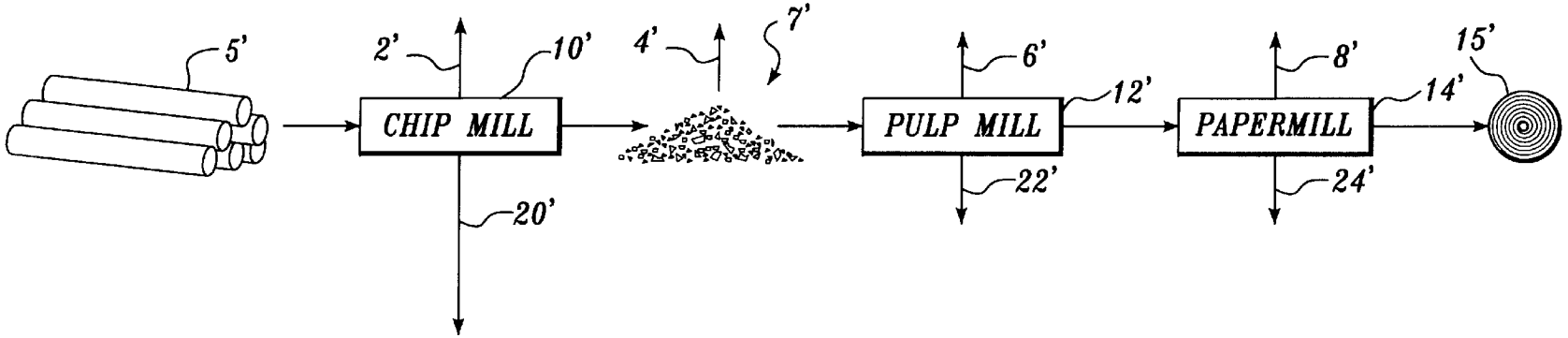
Fig. 1. (PRIOR ART)
FIG. 1 is a schematic block flow diagram of wood chip processing showing VOCs emissions in a papermaking process.

The invention provides paper and absorbent products of enhanced properties. Further, the invention provides a process for making these products that is virtually free of volatile organic compound emissions (or at least have substantially reduced emissions, depending upon the proportion of VOCs extracted) and that is substantially free of pitch-related operating problems. The invention also provides chemical and mechanical wood pulping processes for wood particulates that are virtually free of volatile organic compound emissions.

The processes of the invention use an extractive solvent, that is either a single liquid chemical compound or a mixture of such compounds, for dissolving and removing wood extractives from wood particulates suitable for use as chargestock in pulp and paper operations. The term "wood particulates" refers to wood chips, shavings, sawdust, flakes, and other such solid wood in particulate form. It should be understood, that although the following descriptions may refer to "wood chips," the process of the invention is equally applicable to other wood particulates.

The term "wood extractives," as used in the specification and claims, refers to VOCs and pitch, and is measured as the extractives removed from wood using an ether soxhlet extraction in accordance with TAPPI Standard Test No. T204 om-88, modified to use diethyl ether as a solvent. This test does not distinguish between VOCs and pitch but measures both as ether extractables of the wood. The percent wood extractives removed by the extraction process of the invention is arrived at by measuring the difference between the ether wood extractables in samples of the wood particulates before and after undergoing the extraction process of the invention.

While the specification and claims refer to VOCs and pitch as separate components of the wood extractives, it is recognized that in prior art processes not using the technology of the invention, emissions into the environment include both VOCs and pitch. Under process conditions, a proportion of non-VOC components also volatilizes and accompanies the VOCs as an emission from the process. Frequently, these volatilized wood extractives subsequently condense on process equipment, resulting in fouling. According to the present invention, VOCs and volatilized wood extractives are removed by extraction from the wood particulates.

The term "substantially reduced VOC content" referring to extracted wood particulates, means that at least about 40wt. % of naturally occurring VOCs have been removed by extraction, preferably from about 50% to 100%, and most preferably from about 75% to about 95%.

The term "substantially reduced VOC emissions" referring to a mechanical pulping process means that the process pulps wood particulates from which at least about 40wt. %, preferably from about 50% to about 100%, most preferably about 75% to about 95%, of the VOCs have been removed by an extraction process.

The percentage VOCs removed is calculated by measuring the wood extractives present in particulates before and after the extraction step of the invention using TAPPI method T204 om88 (modified to use diethyl ether as a solvent). Since this method removes other ether extractables besides VOCs, the VOC portion is estimated by heating the extracted wood particulates in an oven to 105° C. for 24 hours and measuring any weight loss. If there is no weight loss, then it is inferred that all VOCs have been removed by extraction. If there is some weight loss, then this indicates the presence of residual unextracted VOCs up to the amount of weight lost. The initial VOC content may be estimated by heating wood chips in an oven to 105° C. for 24 hours, measuring weight loss, and adjusting the weight loss for any loss of moisture content. The adjusted amount of weight loss is the amount of VOCs originally present in the wood particulates.

The term "substantially reduced pitch content" with reference to extracted wood particulates means that preferably at least about 40wt. % of the naturally-occurring pitch has been extracted from the wood, more preferably, 40%–80% of the pitch is extracted, and most preferably 45% to 75% is extracted. As with the measurement of VOCs, the amount of pitch extracted is inferred from measurement of the wood extractives contents before and after extraction by the step of the process of the invention. While the difference between these two measurements is the total amount of ether extractables removed, compensating for the amount of VOCs removed (described above) provides an estimate of the pitch removed.

Preferably, the solvent used in the extraction process of the invention is of a type that can be recycled for reuse in the process. To minimize solvent recovery costs when distillation is used in the recovery process, and to maintain the efficiency of the extraction process, it is preferred that the extractive solvent either does not form an azeotrope with water, or forms only a minima azeotrope. In preferred embodiments, the solvent is applied to raw wood particulates that have not undergone a drying treatment to remove water, and consequently commingles with water. This process is preferred since it avoids costly drying processes. For ease of extraction, the extractive solvent should have a high affinity for wood, i.e., the solvent should readily diffuse or enter into spaces between cellulosic fibers to leach out wood exactives. To facilitate recovery and reuse of the solvent, the solvent should preferably have a physical property that allows ready separation from water, for example, a preferred solvent boils in the temperature range from about 40 to about 75° C. under atmospheric pressure conditions, to facilitate separation by distillation using steam as a heating medium. Alternatively, the solvent could boil at a temperature higher than water, although this is undesirable from an energy usage standpoint. Moreover, the solvent could be immiscible with water, as long as it is able to leach out VOCs or pitch, or both from wood particulates.

As indicated above, the extractive solvent may include a mixture of solvents. In particular, the mixture may include a first solvent that has a particularly high affinity for saponifiable (also known as "hydrophilic") components, and a second solvent that has a high affinity for unsaponifiable (also known as "hydrophobic") components. As a further alternative, according to the invention, the wood particulates may be sequentially subjected to one extractive process using a solvent for the removal of saponifiables, and another extractive process using a different solvent for the removal of unsaponifiables. The order of these two extraction processes is not important.

The extraction process is intended to remove wood extractives such as VOCs and pitch, and not lignin. Thus, process parameters should be controlled to minimize lignin extraction or chemical attack of cellulosic wood components. Both lignin extraction and attack of cellulosic components adversely affect the ultimate yield of pulp from the wood particulates. It is an objective of the invention to maintain yield while removing VOCs and pitch. Consequently, temperature, pressure and time of extraction are controlled to avoid lignin extraction and cellulose attack. Such conditions are referred to, in the specification and claims, as "mild conditions." It is possible, however, to extract VOCs and pitch under conditions of high pressure, thereby reducing the extraction time and the cost of the extraction process.

Preferably, the extraction process is carried out under as mild conditions of temperature and pressure as would require an extraction time of from about two hours to about 10 minutes, or less, to minimize equipment size for a particular rate of chips treated, in tons per hour. Most preferably, the time of extraction is about 30 minutes, or less, and up to about one hour for economical extraction equipment sizing. Extraction time, and hence size of equipment, is also solvent dependent. Certain solvents are better at extracting out the extractives and their leaching or solvent capability is not as strongly adversely affected by increasing concentrations of extractives in the solvent. Such solvents potentially minimize solvent recovery costs because of the lower volumes needed. Because of fast extraction rates, less chip residence time in the extractor may be required thereby minimizing extractor size.

Preferably, the mass ratio of solvent to wood particulates is in the range of from about 6:1 to about 1:1, more preferably about 4:1 to about 1:1, and most preferably about 2:1. However, solvent:wood ratio also depends on extraction time and temperature and pressure conditions. In some cases, depending upon extractor design, solvent will at least be present in sufficient quantity to fill void spaces between wood chips. This may provide a sufficient solvent to wood ratio. In general, longer extraction times require a lower solvent:wood ratio for the same degree of extraction for a particular solvent. Also, higher temperatures and pressures allow reduced extraction time and solvent:wood ratios. The mass ratio of solvent:wood is measured as the total mass of solvent that a particular mass of wood will encounter in a typical extractor of the invention. Thus, even if the extractor is charged with "dirty" solvent that is recycled, without first removing all wood extractives and water, the solvent:mass ratio refers to the total mass of pure make-up solvent and the mass of solvent in the dirty recycled solvent, relative to the mass of wood chips in the extractor.

Temperature and pressure conditions also impose constraints on the selection of the solvent or solvents. Those solvents that are able to effectively remove wood extractives from wood particulates, under mild conditions of temperature and pressure, i.e., conditions that do not cause significant dissolution of lignin or attack of wood cellulosic components, are useful. Thus, it is preferred, within the equipment economic size constraint mentioned above, that the extraction process operate at a temperature in the range of from about 10 to about 150° C., more preferably from about 20 to about 130° C. Preferred pressure conditions range from about atmospheric pressure (14.7 psi) to about 50 psi most preferably from about 15 to about 25 psi. Again, the combination of temperature, pressure and time of extraction should be selected to remove wood extractives without significantly affecting yield, as discussed above.

According to the invention, the preferred solvent for the extraction of VOCs is exemplified by the group consisting of methylene chloride, 1,1,1-trichloroethane, 1,1,2-trichloro-1,2,2-trifluoroethane, trichlorofluoromethane, dichlorodifluoromethane, chlorodifluoromethane, trifluoromethane, 1,2-dichloro 1,1,2,2-tetrafluoroethane, chloropentafluoroethane, 1,1,1-trifluoro 2,2-dichloroethane, 1,1,1,2-tetrafluoroethane, 1,1-dichloro 1-fluoroethane, 1-chloro 1,1-difluoroethane, 2-chloro-1,1,1,2-tetrafluoroethane, pentafluoroethane, tetrafluoroethane, trifluoroethane, difluoroethane, parachlorobenzotrifluoride, cyclic, branched, or linear completely-methylated siloxanes, acetone, methyl ethylketone, methyl isobutylketone, trichloromethane, ethyl ether, diethyl ether, methanol, ethanol, propanol, pyridines, paraffins, hexanes, benzene, toluene, xylene and the like. Other solvents may also be useful. Acetone is the most preferred solvent since it is miscible with water, forms a minimal azeotrope with water, boils at about 56° C., and has a high affinity for wood, while also being an excellent solvent for VOCs. Further, acetone has a favorable EPA classification (not a VOC).

In a preferred embodiment, wood particulates are extracted by the method of the invention without predrying of the particulates. In this embodiment, a polar solvent or mixture of solvents or a hydrophilic solvent is preferred. Alternatively, if the wood is predried through extraction with a hydrophilic solvent (which may also remove some wood extractives), then a hydrophobic solvent may be used to remove any remaining wood extractives. Such a hydrophobic solvent may more effectively dissolve and leach out certain of the wood extractives.

As indicated above, the extractor solvent may include a mixture of solvents. In particular, the mixture may include a first solvent that has a particularly high affinity for saponifiable ("hydrophilic") components of the extractives, and a second solvent that has a high affinity for the unsaponifiable ("hydrophobic") components. As a further alternative, according to the invention, the wood particulates may be sequentially subjected to one extractive process using a solvent for the removal of saponifiable components, and another extractive process using a different solvent for the removal of unsaponifiable components. The order of these two extraction processes is not important Since certain pitch components are higher molecular weight unsaponifiable compounds, these higher molecular weight components are best extracted with a less polar solvent or solvent mixture. Preferably, the solvent or solvent mixture is hydrophobic in nature, such as kerosene, straight chain and cyclic alkanes, aromatics, such as benzene, toluene, and xylene, and the like. Extraction conditions should be controlled, as explained above, to avoid significant lignin or cellulose attack by the solvent. However, the most preferred solvent is acetone. Acetone permits a single solvent to be used for the extraction of both VOCs and pitch components. This facilitates recovery of the solvent by eliminating any requirement for duplication of solvent recovery apparatus.

Pitch is of higher molecular weight than VOCs and such higher molecular weight extractives are best extracted with a less polar solvent or solvent mixture. Preferably, the solvent or solvent mixture is hydrophobic in nature, for example, kerosene, straight or cyclic alkanes, aromatics such as benzene, toluene and xylene, and the like. Most preferably, however, the solvent is acetone, in which case a single solvent may be used for the extraction of both VOCs and pitch. This facilitates recovery of the solvent by eliminating any requirement for duplication of solvent recovery apparatus.

Figure 2:
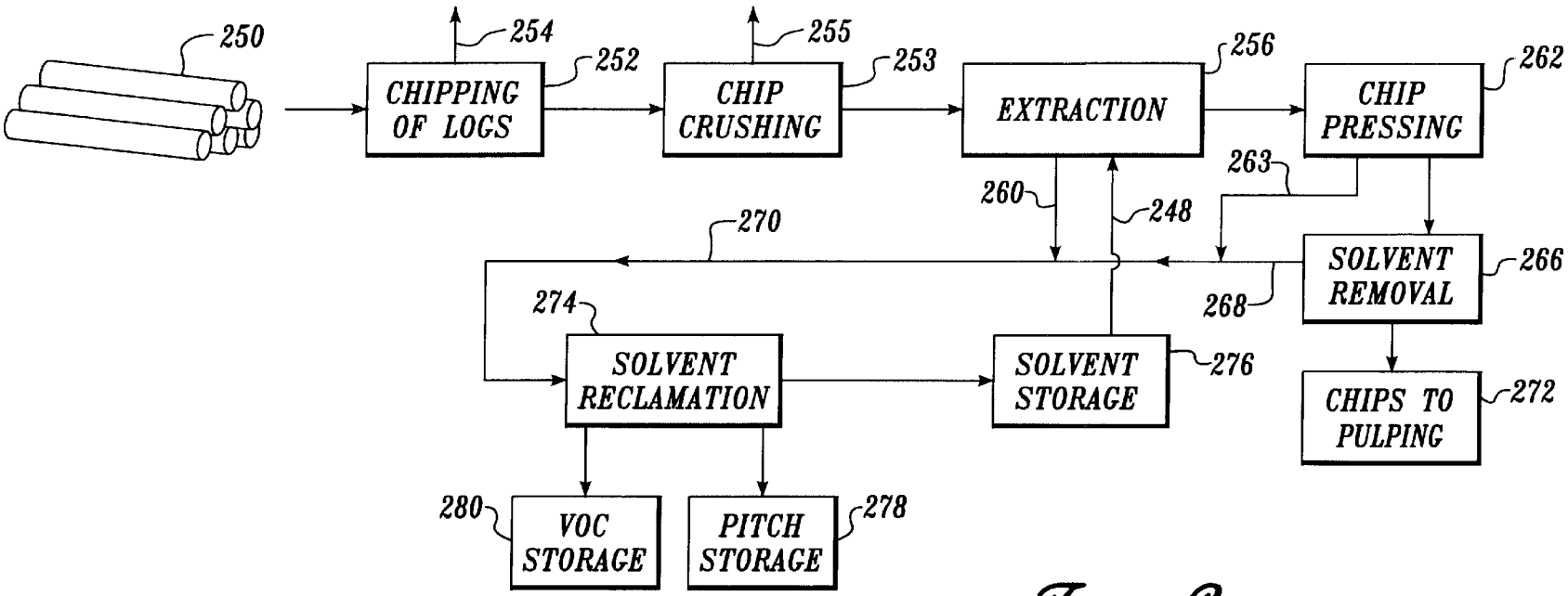
FIG. 2 is a schematic flow diagram of an embodiment of the process of the invention for pitch and VOC removal from wood chips.

For ease of understanding the process of the invention, an embodiment of the invention is illustrated in FIG. 2. As shown, raw logs 250 are charged to a chipper 252 and then optionally a chip crusher 253 for increase in internal surface area. In prior art processes, during the chipping, chip crushing and storage stages, VOCs are released and emitted into the surrounding environment. As explained above, the EPA has set stringent standards on the amount of VOCs that may be emitted. The chipping and chip crushing processes are optionally enclosed within substantially airtight equipment from which air containing VOCs is continuously removed through ducts. This VOC-containing air stream may be purified by passage through air scrubbers, and then optionally activated charcoal filters, or through activated charcoal filters only.

Following the processing of solid product, the wood chips produced in crusher 253, are charged to an extraction operation 256 that removes pitch and VOCs from the wood chips. Preferably, this process is carried out in a counter current operation, as shown in FIGS. 3A, 3B, 3C, and 3D. By "countercurrent" it is meant that the freshest solvent entering the extractor contacts chips that have already flowed through most of the extractive volume, and fresh chips entering the extractor first contact solvent that has already flowed through the extractor. Ideally, in this type of flow arrangement, influent solvent containing the lowest concentration of extractable material, contacts chips from which a proportion of the extractives have already been removed, so that the highest driving force for extraction is maintained. This driving force is proportional to the difference between the concentration of extractives in the solvent and the concentration of extractives in the wood chips.

In the wood chip extractor shown in FIG. 3A, the extractor has a cylindrical housing 300, preferably having a length-diameter ratio of about 4:1. Wood chips enter the compression screw feeder 302 that includes a progressively tapering screw thread 304 within a sleeve 306. Thus, as the screw thread conveys the chips toward the extractor, the chips are progressively compressed in the tapering sleeve. This type of feeder is favored because it can express some water from the chips, facilitating subsequent solvent recovery. Any water expressed in the screw feeder is drained and removed in conduit 303 and routed to VOC, pitch and solvent recovery processes. The compressed chips enter the extractor near its top and flow downward under gravitational force, and the mass of chips continuously added to the extractor. The base of the extractor is supplied with a plurality of screw feeders 304 aligned with the longitudinal axes parallel to the base of the extractor. As these screw feeders 302 rotate about the axes, they convey the chips towards the outlet compression screw feeder 306. During compression of the chips in this outlet screw feeder, residual solvent is removed from the chips. This solvent drains into conduit 307 and is routed to a used solvent storage tank 308.

In order to remove wood extractives from the chips, solvent is added in at least two points in the extractor. In order to mimic, as closely as possible, countercurrent flow conditions, fresh solvent is injected near the base of the extractor; and "dirty" solvent that has already passed through the extractor, and that contains water and wood extractives, is injected nearer the middle or upper section of the extractor. Thus, dirty solvent is controlledly pumped from the used solvent storage tank 308 through an outer concentric conduit 310 into the extractor at a location about midway along the length of the extractor. Fresh solvent is injected in an inner concentric conduit 312 that terminates in a distributor near the base of the extractor. Thus, as fresh solvent rises in the extractor, moving toward the exit pipe 314, it encounters chips that have already undergone extraction with dirty solvent. Consequently, the chips with the lowest concentration of wood extractives come into contact with solvent having the lowest concentration of wood extractives. This provides an optimum driving force for further extraction of wood extractives from the chips. In the upper part of the extractor, entering chips, containing naturally-occurring levels of wood extractives, first encounter dirty solvent. This dirty solvent is still able to extract wood extractives from the chips because of the high concentration of extractives present in the chips.

Ideally, flow of solvent in the extractor is of a plug-flow type. Thus, there is little mixing between fresh and dirty solvent in the portion of the extractor below the fresh solvent injection point. Under these circumstances, the fresh solvent rises in the extractor as a "front" until it meets with upwardly rising dirty solvent. At that point, commingling takes place and the combined solvent mass, including extracted wood extractives, rises upward through the extractor while leaching wood extractives from chips, until the solvent exits the extractor in conduit 314 and is routed to used solvent storage 308. A portion of this solvent is continuously removed and charged through a conduit 60 to a solvent reclamation process, described above.

Figure 3D:
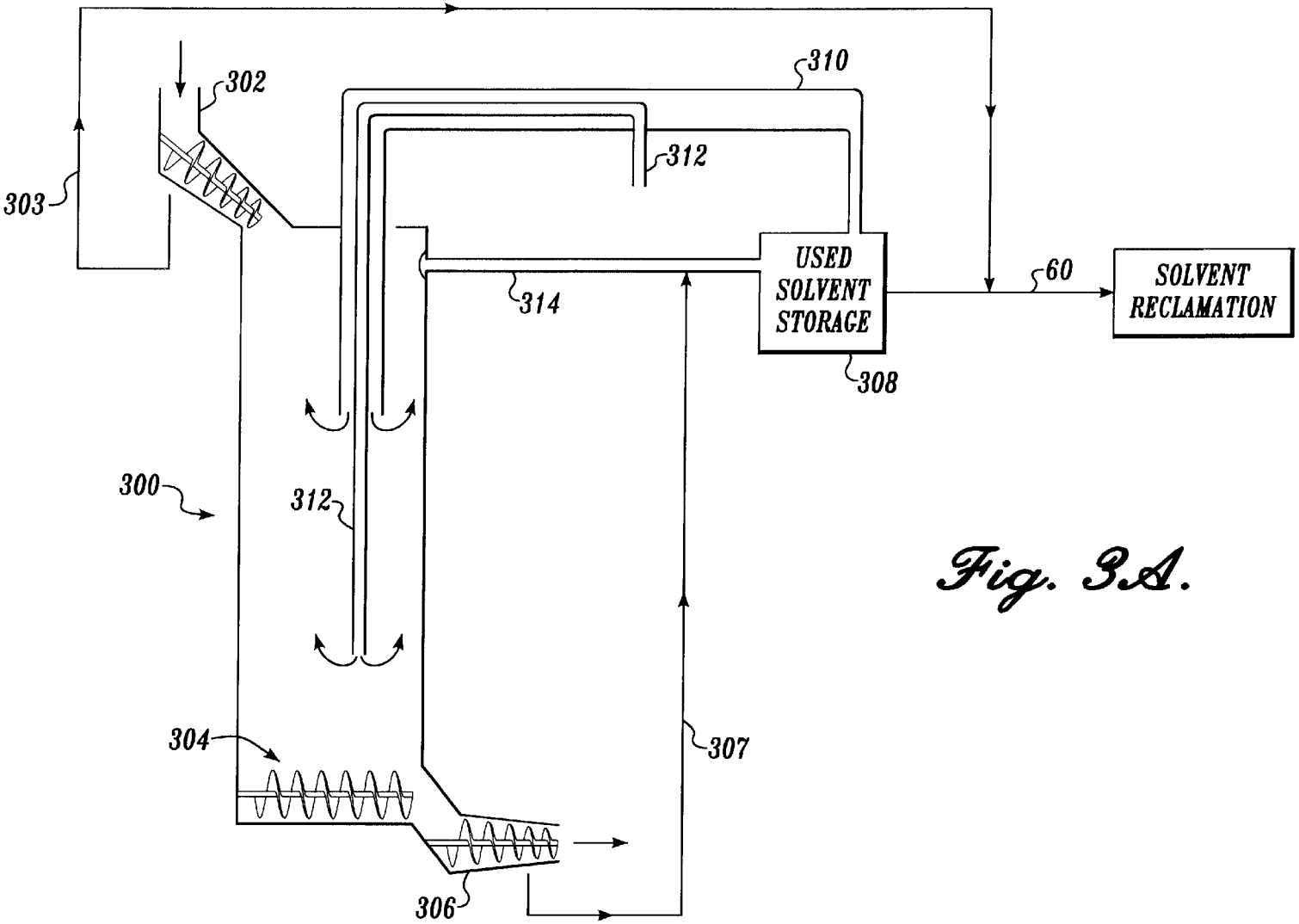
FIG. 3D is a schematic diagram of another embodiment of a chip extractor of the invention.
Figure 3B:
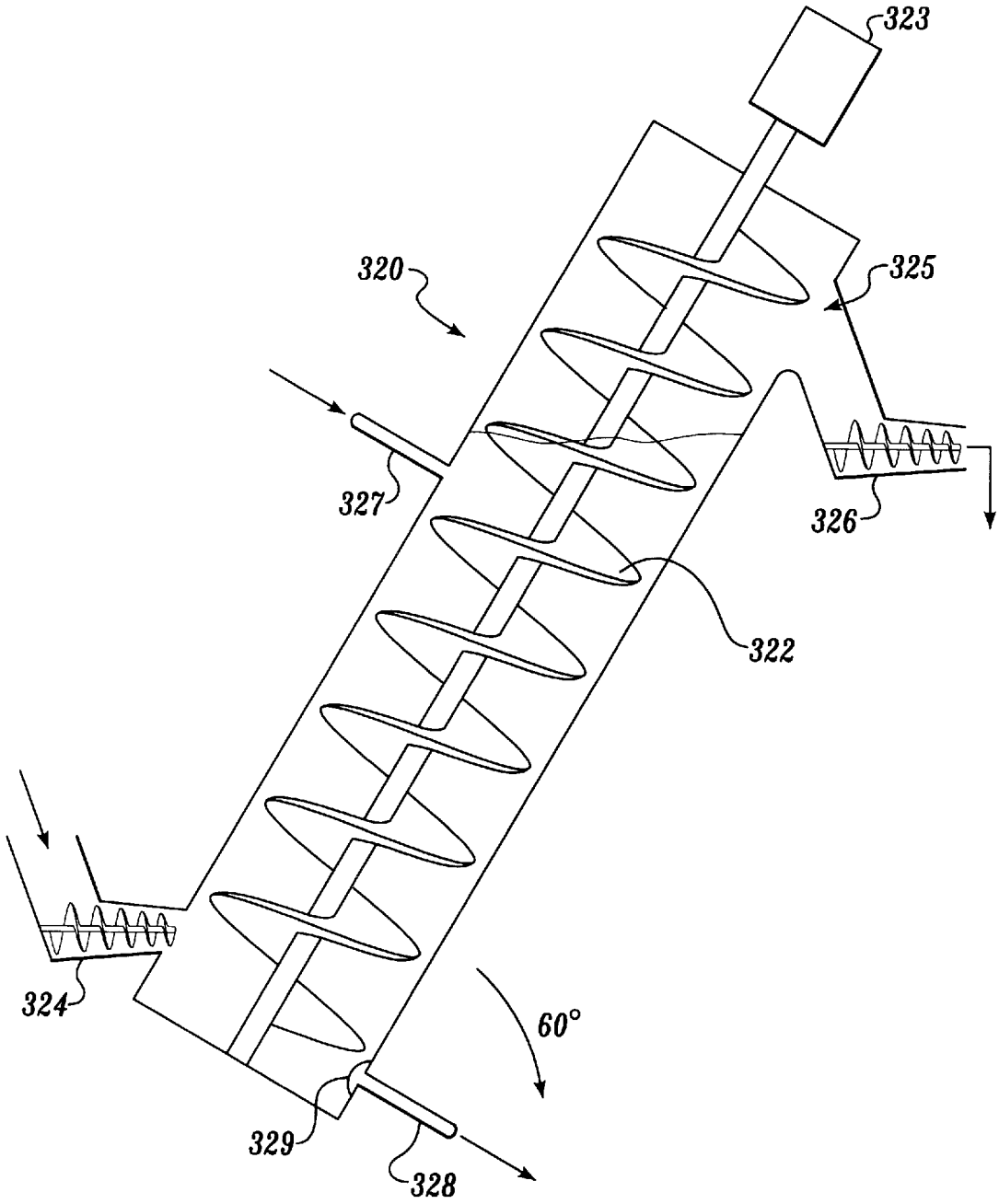
FIG. 3B is a schematic diagram of another embodiment of a chip extractor of the invention.

In an alternative embodiment of the extractor according to the invention, shown in FIG. 3B, the extractor 320 has a cylindrical body inclined at an angle of about 60 to the horizontal. The extractor is supplied with an internal screw 322 that has a longitudinal axis extending along the central longitudinal axis of the exactor and that is rotated by a drive motor 323 to move chips held up between the screw threads from inlet to outlet. Threads of the screw extend outward from the root of the screw at a screw pitch angle, toward the inner surface of the extractor body 320, without touching the inner surface. Thus, the inclined screw 322 is free to rotate, under mechanical power, within the extractor. Chips are fed into the solvent-filled extractor at an inlet near the extractor base by means of a compression screw feeder 324. These chips are captured between the helical threads of the rotating inclined screw of the extractor and conveyed upward until they are expelled from the extractor through a chip outlet 325 near the upper end of the extractor into an outlet compression screw feeder 326. As explained before, the outlet compression screw feeder compresses the chips and expresses residual solvent from the chips. In order to achieve near countercurrent conditions, acetone is injected into the inclined extractor through a conduit 327 near the top of the extractor, and removed from the extractor in an outlet conduit 328, near its base, that is covered by a chip screen 329.

Figure 3C:
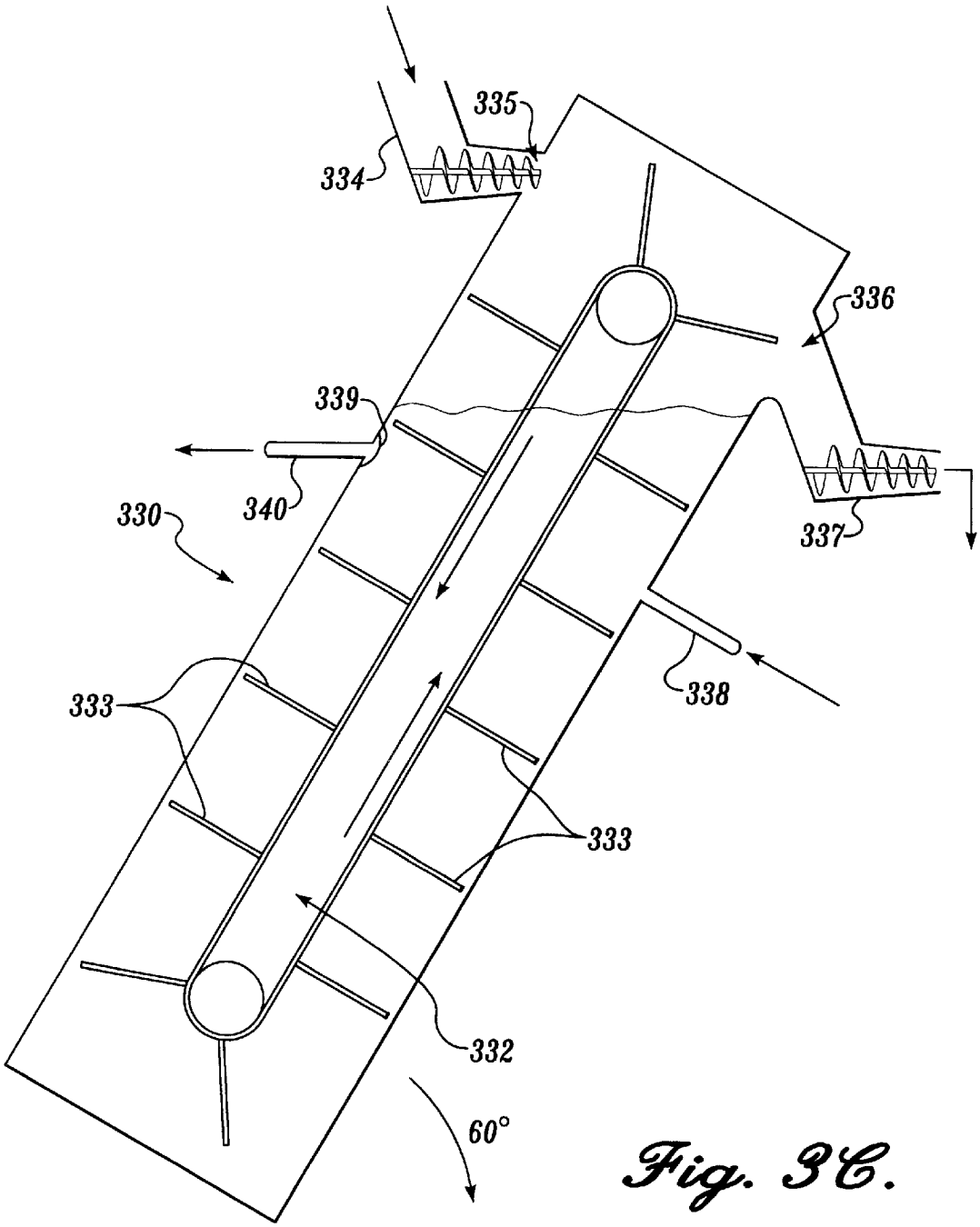
FIG. 3C is a schematic diagram of another embodiment of a chip extractor of the invention.
Figure 3D:
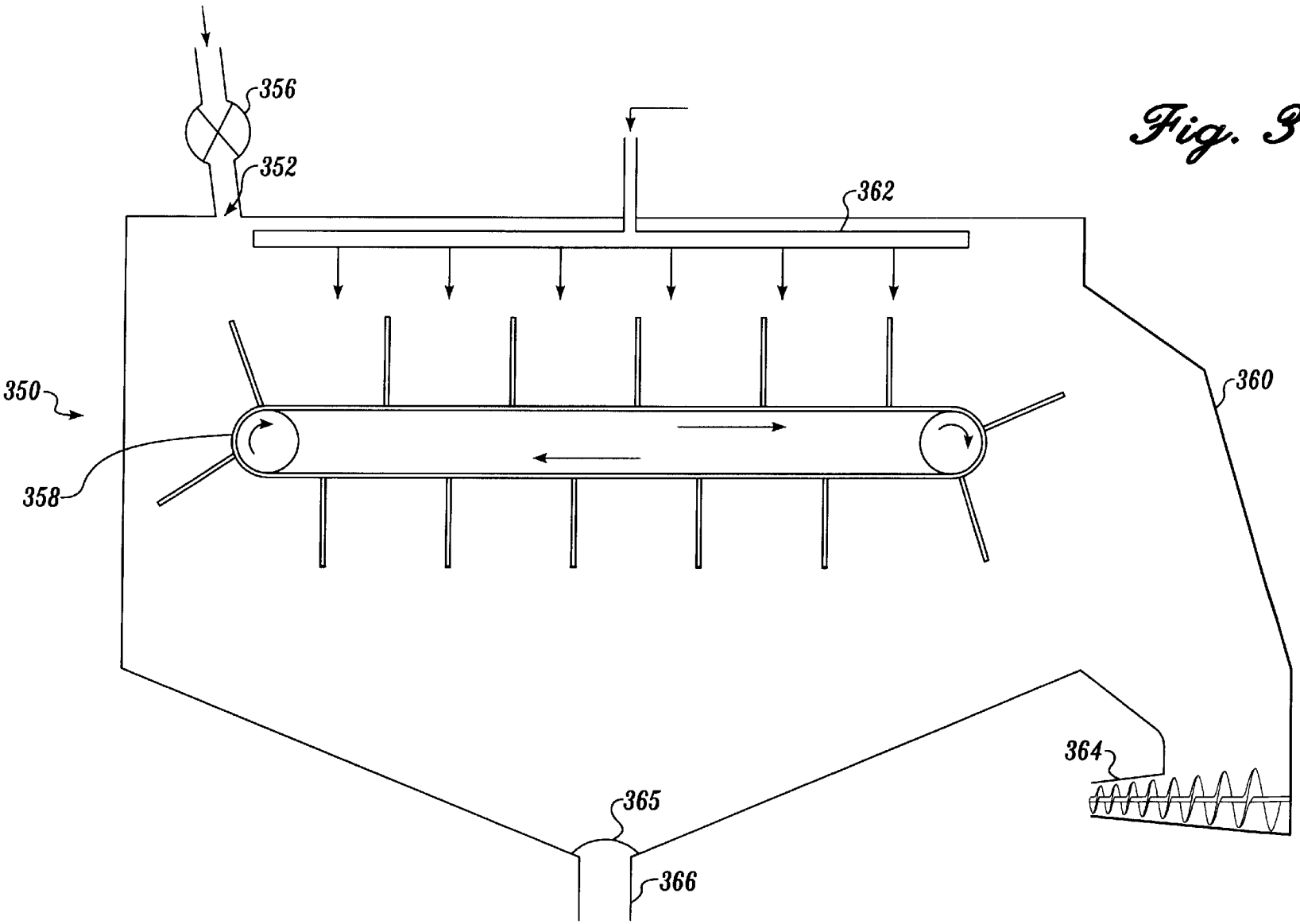

In yet another embodiment of the chip extractor of the invention, shown in FIG. 3C, the extractor 330 is inclined at an angle of about 60°, and is supplied with an internal pan conveyor 332. As is conventional, the pan conveyor includes an endless belt extending substantially along the central axis of the extractor. Containers, or "pans," for carrying chips are formed along the belt by planar sheets, typically of metal, mounted on, and extending at right angles from, the belt at spaced intervals. The sheets extend toward, but do not touch the internal wall of the extractor. Thus, chips are captured in the spaces between the plates and are carried in the direction of movement of the belt. Chips are fed into the extractor inlet 335 by a compression screw feeder 334, located near the top of the extractor, on one side of the pan conveyor belt, and exit from the extractor through an outlet 336 on the opposite side of the pan conveyor belt, near the top of the extractor. The chips are carried away in a compression screw feeder 337. Solvent enters into the extractor through a conduit 338 near the outlet of the chips, and exits from the extractor through a conduit 340, equipped with a chip filter 339, near the chip inlet 335. Thus, the flow through the extractor is not completely countercurrent, but approximates countercurrent conditions for at least the partially-extracted chips on the exiting side of the pan conveyor.

In a further alternative embodiment of the chip extractor of the invention, shown in FIG. 3D, the extractor is enclosed in a housing 350 that has a cone-shaped bottom for drainage of solvent and an exit chute 360 at an end opposite the chip feed inlet 352. Chips enter the extractor through a rotary feeder 356 above chip inlet 352 and fall onto an internal pan conveyor 358 that is disposed longitudinally within the housing 350 to carry the chips to the other end of the housing where the chips are spilled into the chute 360 for removal. A solvent distributor 362 extends above and along the entire length of the internal pan conveyor 358. The solvent distributor is supplied with a plurality of holes to allow solvent distribution across the entire mass of chips conveyed on the pan conveyor. The solvent extracts wood extractives from the chips, while percolating through the chip mass. Solvent containing leached extractives falls towards the cone-shaped bottom of the extractor and is removed through solvent outlet pipe 366, located at the apex of the cone-shaped housing bottom, that is covered with a chip screen 365. The extracted chips, as explained above, falls off the far end of the pan conveyor into chute 360 and are then removed through exit screw press 364. The screw press, by compression, removes residual solvent from the chips.

As can be seen from the above, the extraction of wood extractives from wood chips may be achieved with a variety of extractor designs of the invention. The nature of wood chips, and wood particulates, impose certain limitations on the nature of the equipment. Wood chips, for example, tend to interlock and form stable packed structures when placed within a container, such as an extractor, or a silo. The above-described designs overcome this tendency by providing either inclined screws, pan conveyors, or screws near the base of the extractor to facilitate chip movement in the extractor and chip removal from the extractor. The designs, especially those of FIGS. 3B, 3C and 3D, also reduce channeling of wood chips from inlet to outlet of the extractor and facilitate control of chip residence time in the extractors.

Referring to FIG. 2, in the extraction stage 256, the wood chips are immersed in the extraction solvent supplied in conduit 248 from solvent storage 276. Mild agitation, while preferred, is not necessary. During the immersion, solvent surrounds and penetrates the wood chips dissolving and leaching wood extractives, including VOCs and pitch, from the structure of the wood chip. Preferably, the solvent penetrates to and removes extractives from the resin canals of the wood as well as the parenchyma cells of the wood. This removal or "leaching" of extractives from the wood takes place under conditions of temperature and pressure that do not cause substantial attack of the lignin or cellulosic component of the wood. Thus, the high temperatures and pressures used in prior art processes designed to delignity wood or to pulp wood using solvents (often in combination with catalysts) are not employed. Instead, the integrity of the cellulosic component is maintained as wood extractives are leached out. Moreover, the lignin component of the wood is also not affected, or only insignificantly affected, so that the wood particulates are not pulped. Only removal of a sufficient proportion of extractives to substantially eliminate subsequent VOC release from the leached wood chips and to eliminate the need for pitch-scale treatment chemicals in subsequent pulping operations, is required according to the invention. In certain instances, external heat may be supplied to facilitate leaching. Moreover, in certain instances, pressure may be applied in the extraction process to prevent vaporization of the solvent. However, in the preferred embodiment, using acetone as a solvent, leaching can take place at either ambient conditions of temperature and at about atmospheric pressure conditions, or at slightly elevated temperature and pressure to increase extraction rate.

The extracted wood chips are separated from solvent in the extractor(s) and transported to optional chip pressing operations 262 for removal of residual solvent and extractives, for instance in screw presses. The solvent, containing water, pitch and VOCs, now called a "miscella" is removed in conduit 260 for processing to recover solvent for reuse, and pitch and VOCs for sale or combustion.

In the optional screw presses, the extracted wood chips are subjected to mechanical pressure causing squeezing and compression of the chips. As a result, residual solvent containing pitch and VOCs is expressed from the chips. This liquid is conveyed in a conduit 263 to the solvent and pitch recovery processes, as will be described later. The compressed wood chips, still containing residual solvent, are charged to a solvent removal stage 266.

Solvent removal may be effected by conventional means, such as charging to a rotary drum dryer, or continuous dryers that comprise a multiplicity of drying stages enclosed in a housing and subjected to hot air and direct steam that removes solvent from a substrate to be dried. To facilitate drying, the air should be preheated to at least the boiling point of the solvent. Solvent vapors removed during this stage are carried by conduit 268 in the air stream to processes for solvent recovery. The substantially solvent-free leached chips, with reduced VOC and pitch content, are charged to a pulping process, generally designated by the numeral 272. As a result of the extraction of VOCs and pitch, in the process of the invention, VOC emissions during the pulping operations are significantly reduced. Furthermore, as explained above, paper and absorbent product manufacturing processes are enhanced, by the virtual elimination of pitch that causes fouling of equipment and related loss in efficiency and production. The quality of paper and pulp products is also improved, as explained above.

In an important aspect of the invention, the extractive solvent used in the VOC and pitch extraction stage is recovered and recycled for reuse. As shown in the illustrative embodiment of FIG. 2, liquid streams 260, 263 and 268 containing solvent, from extractor(s) 256, optional chip pressing 262, and solvent removal 266, respectively, are gathered in header 270 which charges the solvent-containing fluids to a solvent reclamation stage 274. In this solvent reclamation stage, solvent is separated from a VOC product and a pitch product. The solvent is routed to solvent storage 276 for reuse in the extraction process 256. The VOCs are routed to VOC storage 280 for sale or use as a fuel. Likewise, pitch is routed to pitch storage 278 for sale or use as a fuel. Solvent reclamation can be carried out by distillation or by other separation processes. Preferably, from about 95 to 98%, or more of the solvent is recovered.

It is important to note that the volatile organic compound product produced, and the pitch product produced, are not necessarily "pure." Rather, the VOC product may contain at least some, although minimal, amount of solvent, as well as water. The pitch product will contain pitch as well as water. Pitch by itself solidifies at room temperature and is difficult to handle. While the pitch may be spray-dried into pellets for handling, it is preferred that the pitch product contain less than about 50 wt. % solids so that it may be maintained in a liquid state, either at ambient temperature or with the addition of economically minor amounts of heat or waste heat. This liquid pitch product is more readily pumped into heated tank cars for sale.

The extracted chips, after drying to remove any residue or solvent, are then either stored, or charged directly to a pulp mill for the production of wood pulp. Any of several available commercial processes may be used to produce wood pulp from the extracted wood particulates, according to the invention. Thus, mechanical (including "thermomechanical"), kraft, sulfite, or any other process, may be used to produce an aqueous slurry containing a suspension of wood fibers that may be charged to a paper-making machine to make paper or absorbent products.

In those pulp mills using a mechanical pulping process, the chips are first subjected to steam heating and then also subjected to mechanical fiberizing forces and heat generated by these forces. The mechanical forces cause the wood chips to cleave or delaminate along longitudinal boundaries between wood fibers to produce separate wood fibers. These fibers are then combined with sufficient water to produce a pumpable aqueous pulp that may be processed into paper and other absorbent products.

The process of the invention is applicable in a range of mechanical wood pulping processes. These processes include, but are not limited to, the stone ground wood process (SGW), the pressurized ground wood process (PGW), the refiner mechanical pulp process (RMP), the thermo-refiner mechanical pulp process (TRMP), the pressure refined mechanical pulping process (RMP), the thermomechanical pulp process (TMP), the pressure/pressure thermomechanical pulping process (PPTMP), the chemi-refiner-mechanical pulping process (CRMP), the chemi-thermo-mechanical pulping process (CTMP), the thermo-chemi-mechanical pulping process (TCMP), the thermo-mechanical-chemi pulping or OPCO pulping process (TMCP), the long fiber chemi-mechanical pulping process (LFCMP) and the chemically treated long fiber process (CTLF). Thus, the process of the invention is applicable in both "pure" mechanical processes, as well as "hybrid" processes that employ a combination of either chemical or thermal, or both, treatments in conjunction with mechanical treatments to produce a pulp from wood particulates.

Figure 4:
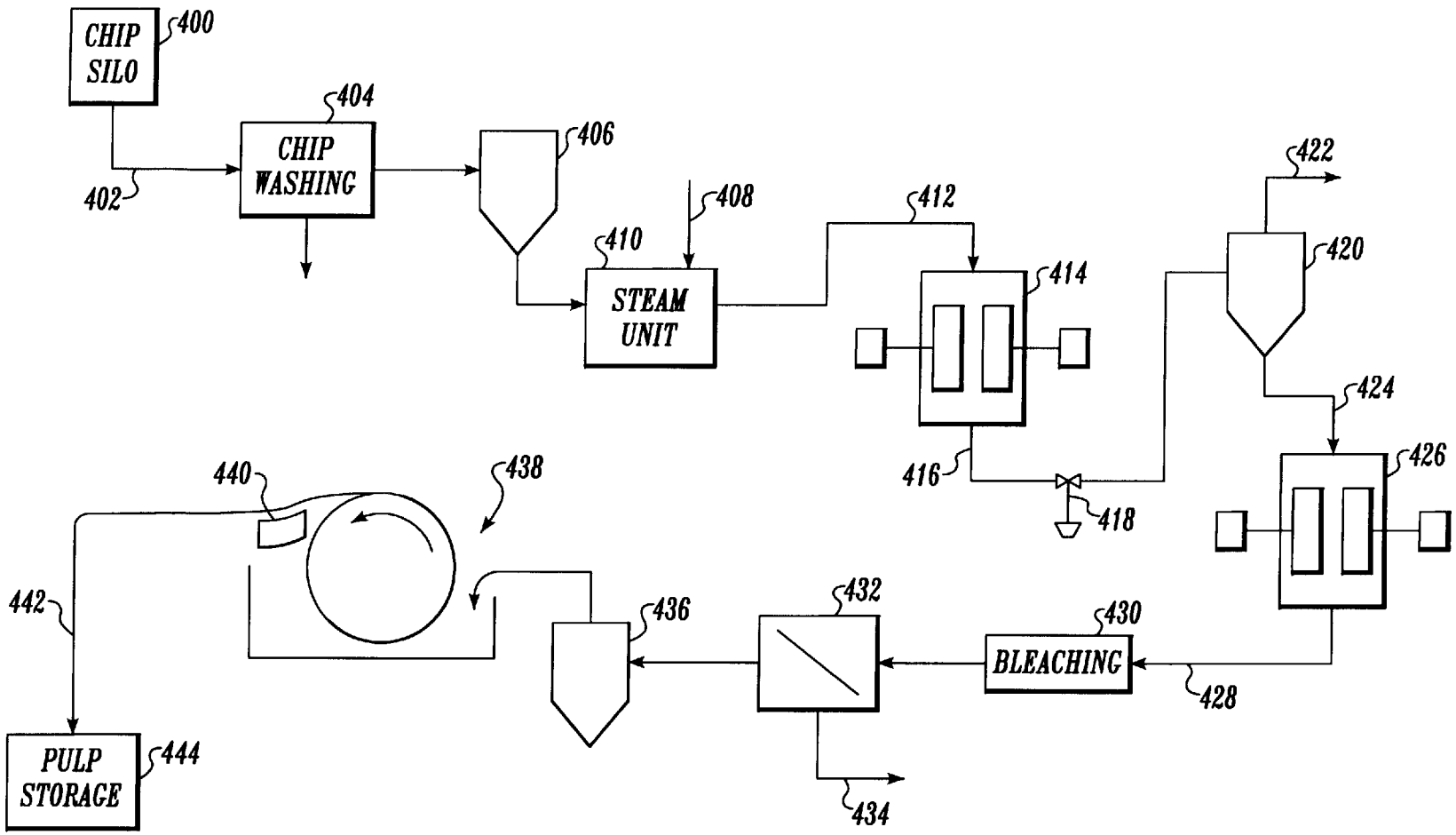
FIG. 4 is a schematic process flow diagram of an embodiment of a mechanical pulp mill process of the invention.

An embodiment of an exemplary mechanical pulping process of the invention, using reduced pitch content, substantially VOC-free wood particulates as a reduced chargestock, is shown in FIG. 4, it being understood that the process of the invention is also applicable to other mechanical wood pulping processes. Optionally, the extracted chips are charged through conduit 402 from chip silo 400 to a chip washing process 404 to remove sand and other debris. The cleaned chips are then conveyed to a surge hopper 406 from which they are charged to a steam unit 410 where the chips are exposed to low-pressure steam, typically at about 35–65 psig, charged through conduit 408. The heated chips are then charged through line 412 into the first of a series of from about 2 to about 4 mechanical refiners. The first refiner 414 is operated under a slightly elevated pressure. The chips are charged to the spacing between two opposing grinding surfaces in the refiner that are rotated in opposite directions by their respective drive motors. The chips, caught between the grinding surfaces, are delaminated or cleaved, usually along interfiber boundaries, to produce individual fibers. Fibers and unfiberized chips exit from the refiner through conduit 416 and pressure let-down valve 418 to enter a separator 420. In the separator, steam exits through a central pipe 422. Significantly, unlike in prior art processes, this exiting steam is substantially free of VOCs and volatile wood extractives. The fibers and any unfiberized chips continue through conduit 424 to a second refiner, atmospheric refiner 426. Here any remaining large wood chips are further subjected to mechanical fiberizing. Once again, unlike in prior art processes, this refining process is substantially free of VOC and volatile wood ettractive emissions. Wood fibers are carried from the refiner through conduit 428 to a bleaching unit 430, where the fibers are chemically treated to a desired level of brightness than in the prior art processes. Significantly, in accordance with the invention, because the wood fibers have reduced pitch content, less bleach is required to achieve a desired level of brightness. The bleached wood pulp is then charged to a screen 432. The oversized fraction, representing incompletely fiberized wood particulates, are returned in conduit 434 to one of the refiners. The screen undersize passes through to a cleaning stage 436 and thence to a thickener 438, while any oversize is recycled for re-refining. The thickener, typically a rotary drum filter, forms a filter cake of pulp on its filter surface that is removed by a doctor blade 440. The caked pulp 442 is then transported to pulp storage 444. This pulp may then be used for the manufacture of paper and absorbent products. More typically, mechanical pulps are utilized for the manufacture of newsprint.

Ordinarily, in prior art processes, large amounts of VOCs and other naturally-occurring volatilized wood extractives would be emitted into the environment along with the steam released in conduit 422; through vents in the bleaching process 430; through vents from the secondary refiner 426; and from the thickeners 438. However, the mechanical pulping process of the invention substantially reduces or eliminates these emissions of naturally-occurring VOCs and volatile wood extractives.

Chemical pulping encompasses all those wood pulping processes that incorporate the use of chemicals to dissolve lignin and thereby cause physical separation between wood fibers held together in a wood particulate, sometimes with the aid of mechanical forces. The chemical pulping processes include, for example, the sulfite (or acid) process, the kraft process, and the alkaline or soda process. In the kraft processes, the sulfide ion is the active reactant, in the acid process the bisulfite ion is the active reactant. The process of the invention is applicable to any chemical pulping processes.

In general, in a chemical pulping process of the invention, a reactant, or reactants, is combined with solvent-extracted wood particulates of reduced VOC and reduced pitch content in a digester, under controlled conditions of temperature and pressure, for a time sufficient to solubilize and remove lignin, a component that holds fibers of the wood together in a unitary structure. As a result, individual wood or cellulosic fibers are separated from each other in an aqueous liquid medium, to form a pulp or slurry. Typically, water is then added to this pulp to form a stock slurry of weak black liquor to facilitate pumping. The fibers are washed to remove lignin and other impurities. The cleaned fibers are then mixed with water to form a stock for forming into paper and absorbent products. The pulp may also be bleached by, for example, chlorine or "non-chlorine" bleaching techniques.

Figure 5:
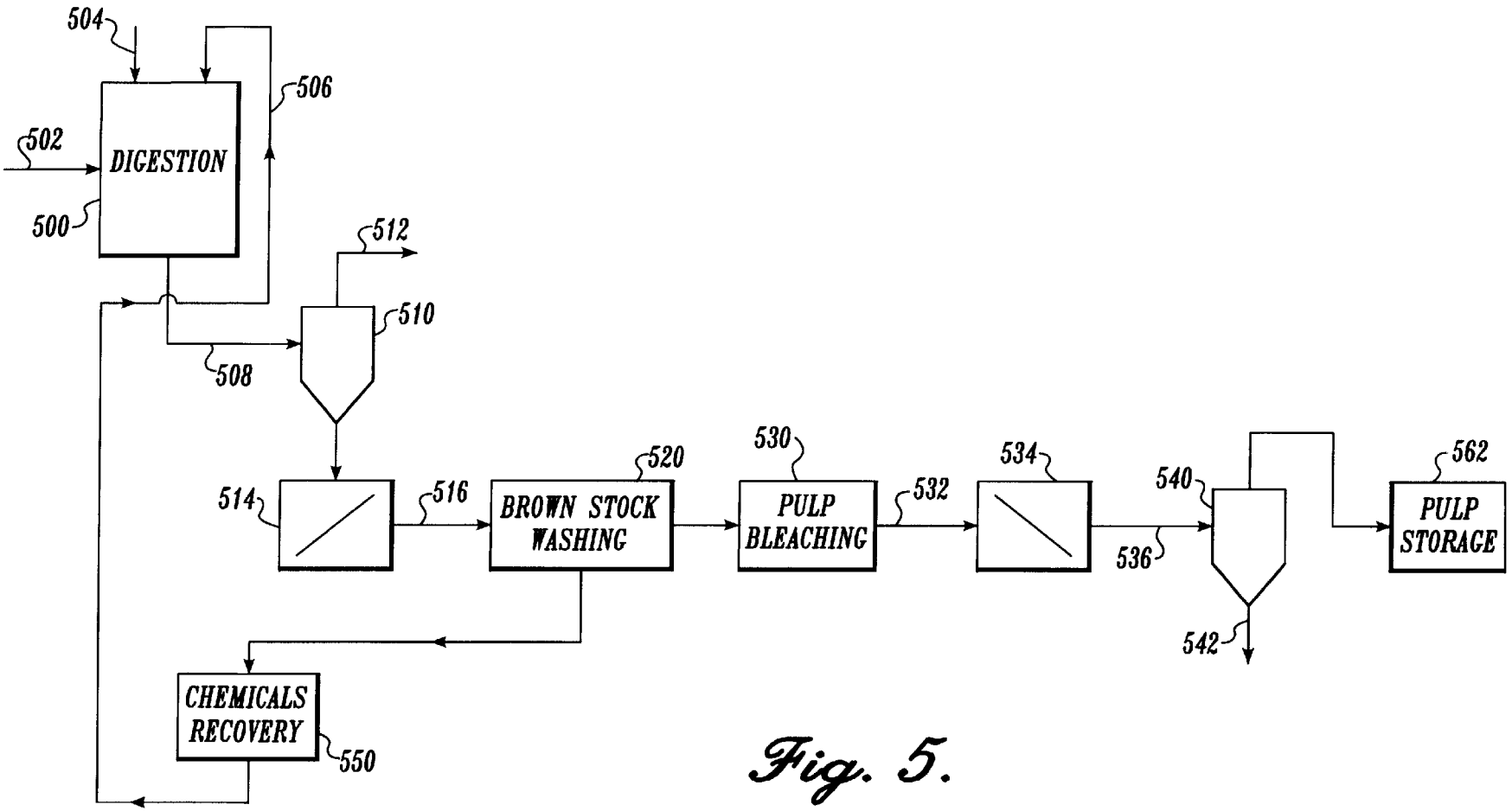
FIG. 5 is a schematic process flow-type diagram of an embodiment of a chemical pulping process of the invention.

FIG. 5 is a schematic that is illustrative of the major process operations in a typical chemical pulping process. The various chemical pulping process are well-known in the art and the following explanation more clearly points out the benefits of the invention as applied to any of the chemical pulping processes. In general, reduced VOC and pitch-content chips 504 are charged to a digester 500 along with black liquor in conduit 502, and a predetermined amount of white liquor in conduit 506 to provide the appropriate liquor to chip ratio. Typically, the liquor-to-oven dry chip ratio in the digester is from about 3.5 to about 4.5. The cooking liquor is maintained at cooking temperatures ranging from about 160 to about 175° C. and digestion time may vary from about 30 minutes to about 150 minutes depending upon the degree of complete separation required between individual cellulose fibers, or the degree of delignification required. At the end of the digestion process, the pulp mass contents of the digester are blown through conduit 508 into a blow tank 510 of cyclone-type design so that steam and noncondensable gases are emitted through a central pipe 512. According to the invention, since a significant proportion of the VOCs have been removed from the chips, VOC emissions through this central pipe 512 are significantly reduced. The digested pulp mass, leaving the bottom of the blow tank, is charged to a screen 514 for removal of any large undigested wood particulates. The pulp flowing through the screen is charged through conduit 516 to a pulp washing stage 520. Typically, the pulp, or "brown stock", washing is carried out on a series of rotary drum filters. The washing process produces a washed or cleaned pulp that is then charged to a pulp bleaching stage 530. At this point, bleaching chemicals are added to the pulp to achieve the required pulp brightness. The bleached pulp is then charged through conduit 532 to a screen 534 and the screened pulp is finally charged to a cyclone-type cleaner 540 that removes fine, broken cellulosic particles through conduit 542 while charging the separated longer-fibered pulp to pulp storage 562. This pulp may then be charged to processes for maining paper and absorbent products.

Ordinarily, in prior art processes, VOCs are emitted during the pulp washing stages at the blow tank 510, on the rotary drums of the pulp washing stage 520, and in the bleaching step. However, in accordance with the invention, since the VOC content of the wood particulates charged to the pulping process has been reduced, VOC emissions are also significantly reduced. Moreover, the removal of VOCs and pitch reduces the requirement for chemicals supplied in the white liquor since pitch and VOCs would consume some of the chemicals in the digester. This savings in chemicals provides a significant cost saving. Moreover, since the pitch content of the pulp is significantly lower than in the prior art, less energy is required in the recovery stage 530, as explained below. Also, pitch fouling of equipment is significantly reduced allowing higher process equipment utilization rates.

The pulp washing stage 520 also produces a wash black liquor that is routed to a chemical recovery system 550. White liquor is regenerated from the black liquor and may be recycled, as shown, in conduit 506 to the digester. As a consequence of the removal of a significant proportion of pitch from the wood pulp, the quantity of heavy black liquor that is charged to the recovery boilers, process units in the recovery section 550, is reduced for a given amount of pulp production. Consequently, it is estimated that pulp production may be increased, typically from about 2 to about 3%, until the boiler solids limit is once again reached. This provides an effective debottlenecking of the chemical recovery operation, without the requirement of any further capital investment.

As explained above, the invention provides significant advantages in any of the chemical pulping processes, ranging from significantly reducing potentially harmful emissions of VOCs, to the reduction in chemical consumption and reduction in energy consumption for a given tonnage of pulp production. Moreover, the reduced pitch content pulp produced has significantly enhanced properties that allow the production of superior quality products.

Pulp produced by any standard pulp-making process, such as mechanical or chemical pulping processes, can be made into paper. Papermaking machines include at least three sequential sections, each performing a separate primary function and each in operating communication with any prior or subsequent sections in the sense of receiving a continuous unfinished paper web from a prior section, or conveying the web to the next section, for further processing. In the first section, the "forming section," an aqueous suspension or slurry containing about 0.5 to 1.0 wt. % paper pulp fiber of reduced pitch content, made in accordance with the invention, is formed onto an endless wire mesh belt to form a wet fibrous mat on the belt. The mesh construction of this endless belt permits rapid drainage of water from the fibrous mat under gravity and applied suction to produce a web containing about 20 wt. % solids that is conveyed to the next section, the "press section." In this section, the paper web is supported on a series of air- and water-permeable felts that convey the web through a series of press nips between horizontal, cylindrical rollers to mechanically express and remove water from the web. When the water content of the web has been reduced, so that the web contains about 35 to 45 wt. % solids, the web is transferred to the next section of the papermaking machine, the "drying section." In this section, the partially dried web is contacted with a series of heated drums or cylinders to evaporate water from the web and produce a finished product having a dryness of about 90 to 95%. The web is conventionally unsupported at certain points in the process as it travels between press nips and heated drums in the drying section. Web strength is therefore a factor in determining the rate of papermaking. Continuous high speed operation is not feasible when the web is weak, and subject to breaking.

Given the high capital cost of papermaking machines, it is desirable to maximize paper productivity. Thus, machines that are not rate limited, due to limitations in the forming or drying sections, are run at ever increasing speeds to increase production. However, a practical rate limit is reached where increased productivity is offset by increased production losses due to breakages of paper web and product defects.

Paper web strength is at least in part dependent upon the pitch content of the pulp and also the type of wood from which the pulp is derived. In the invention, pulp pitch content is reduced so that pulp strength is increased thereby potentially allowing higher speed papermaking operations. Moreover, reduction in pulp pitch content substantially eliminates production losses due to equipment downtime caused by pitch fouling.

Figure 6:
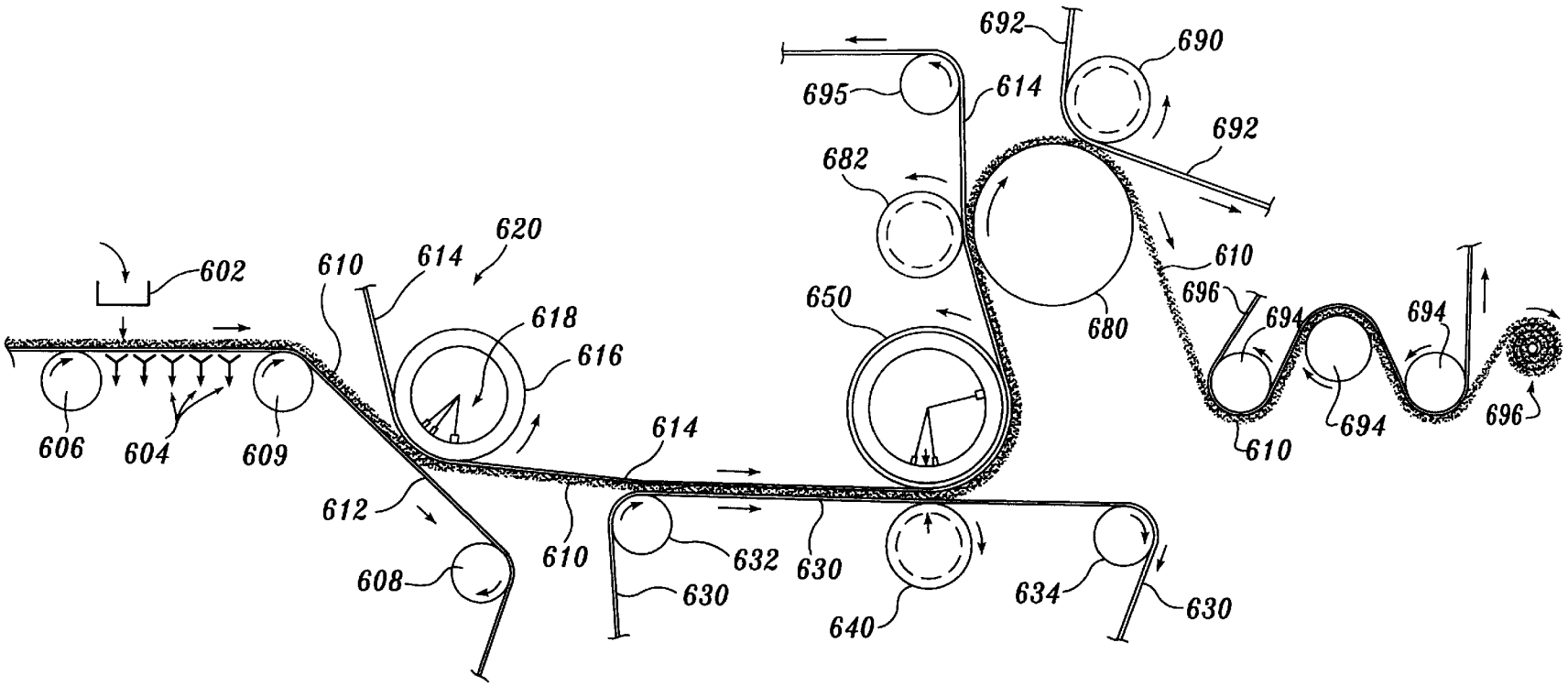
FIG. 6 is a schematic diagram of an exemplary papermaking machine for processing reduced pitch content pulp of the invention into paper or absorbent products, showing the paper forming, pressing and drying sections, in simplified form.

FIG. 6 illustrates schematically a typical papermaking machine 600. In the paperforming section, a slurry of 0.5–1.0 wt. % reduced pitch content pulp fiber enters one of a plurality of header boxes 602 that form a wet web 610 onto a continuous, endless wire mesh belt 612. Belt 612 is supported and transported by rollers exemplified by rolls 608 and 609. While on the belt, web 610 is dewatered by natural gravity flow of water from the web as well as by vacuum suction applied by several suction conduits 604 located beneath mesh 612 and in fluid communication with web 610. Upon exiting the forming section, the web enters the press section. In this section, the web 610 is urged against an endless pickup felt 614 that is supported by a cylindrical pickup roll 620 having a rotatable outer perforated shell 616 and an internal stationary vacuum compartment 618, in fluid communication with the felt through perforations in the outer shell 616. Thus, the continuous web 610 is continuously transferred by vacuum assist onto the pickup felt 614. The web is then sandwiched between pickup felt 614 and a bottom felt 630. This bottom felt is guided around roller 632 into contact with the other surface of the wet paper web 610. This layered arrangement of felts with an intermediate wet paper web is then fed into a press nip between a suction roll 650 and a circumferentially grooved roll 640 where pressure is applied on the lateral surfaces of the felts and web, as shown by the arrows in FIG. 6, to express water from the wet paper web.

After dewatering between the suction roll 650 and the grooved roll 640, the bottom felt 630 is conventionally separated from the paper web, guided around roll 634, and returned continuously back to roller 632. The paper web 610, carried on pickup felt 614 proceeds to a second nip press between a grooved roll 682 on the felt side, and a smooth roll, such as a granite roll 680, on the paper side. As a result, the paper web adheres to the granite roll and the pickup felt 614, now separated from the paper web, moves continuously around guiding roll 695, back to the first pickup roll 620. The adhered paper web on roll 680 is carried by rotation of the roll into a nip between a second felt 692 and a supporting perforated roll 690 to further express water from the web. Upon exiting from this nip press, the second felt 692 separates from the paper and is continuously guided to a return to the perforated roll 690. The paper web, now unsupported, is transferred to the drying section of the paper machine.

The drying section of the papermaking machine conventionally also consists of a series of rolls, heated and/or supplied with hot air to remove moisture from the paper web to produce a continuous dried roll of paper. Thus, web 610 is drawn onto felt 696 and is carried around a series of heated rollers 694 before separating from the felt. The dried paper web is then conveniently wound onto a roll 698.

In accordance with the invention, the foregoing typical papermaking process, and any other papermaking process, is used to produce paper and absorbent products from the reduced pitch content pulps of the invention. This results in the production of paper and absorbent products of reduced pitch content, that have superior brightness, strength and optical properties. As explained before, due to the increased pulp strength, there is also a possibility of increasing the rate of operation of the papermaking machine due to the superior strength of the pulps of the invention, provided that the particular machine is not rate limited by its drying section.

The properties of products produced according to the invention are significantly enhanced relative to products made of comparable "mw" wood particulates, i.e. wood particulates that were not extracted by a solvent, as described above. The burst index increases by from about 10 to about 600%, preferably about 50%. The tear index increases by from about 10 to about 35%, preferably about 30%. The tensile index increases by from about 10 to about 40%, preferably around 35%. The Scott Bond increases by from about 10 to about 30%, preferably about 25%. The density of the products increases by from about 2 to about 10%, typically around 5%. Sheffield Smoothness increases by from about 10 to about 25%, preferably around 20%. Stiffness increases by from about 5 to about 15%, preferably around 10%. The stretch of the products of the invention increases by from about 5 to about 15%, preferably around 12%.

While optical properties, as measured by brightness, decreases by around 10%, it has been found that less chlorine or non-chlorine bleach is required to achieve a desired brightness with pulps of the invention. That is, the pulps of the invention are markedly more responsive to bleaches and demonstrate a higher gain in brightness when undergoing bleaching.

Significantly, since the pulp has reduced pitch content relative to pulp obtained from wood particulates that have not undergone the extraction process, fouling of the papermaking machine equipment with pitch is significantly reduced, or entirely eliminated, depending upon the proportion of pitch that is extracted. Consequently, papermaking machine down time caused by pitch fouling is either reduced or eliminated and product wastage caused by pitch deposits on the machine and the machine clothing is eliminated. Indeed, the pulps of reduced pitch content of the invention not only produce products of superior quality, but also reduce the operating costs of papermaking machines. Finally, and importantly, depending upon the level of VOC extraction, VOC emissions are substantially reduced or virtually completely eliminated from the papermaking process.

The following examples are illustrative of aspects of the invention and do not in any way limit the scope of the invention, as described above and claimed herebelow.

EXAMPLES

Example 1

Comparison of Solvents for the Removal of Wood Extractives

A series of solvents were tested to determine which was most effective for the extraction of wood extractives, including volatile organic compounds and pitch. In each of the tests, 50 gram batches of oven dried Lodgepole Pine wood chips were extracted with solvent at a solvent:wood mass ratio of 4:1. Samples of each batch were each analyzed for wood extractives, using a modified TAPPI test method T204 om-88 with diethyl ether as the extraction solvent, before and after extraction with the test solvents.

In each case, the batch of wood chips was subjected to a batch extraction process. The wood chips were not predried, so that their condition approximated that of wood chips normally received for treatment in a wood pulping facility, or used in a composite wood product manufacturing facility. The wood chips were preheated with atmospheric steam for 30 minutes. During this time, the wood chip temperature rose to about 95° C. The wood chip batch was then immediately submerged in the extraction solvent. In each case, the solvent:wood ratio was 4.0 and the extraction time was 30 minutes. After extraction, solvent was drained from the chips, and the chips were subjected to a second heating cycle of 30 minutes with atmospheric steam. Thereafter, the chips were subjected to a second extraction cycle using the same solvent at the same solvent:wood ratio. After draining solvent from the chips, the chips were analyzed to determine the amount of residual wood extractives. The percent wood extractives removed was calculated for each batch and the results are reported in the accompanying Table 1.

TABLE 1

| Treatment Solvent | Percent Extraction |
|---|---|
| Peracetic Acid | 45.8 |
| Caro's Acid | 14.2 |
| Hypochlorous Acid | 37.5 |
| Deionized Water | 41.0 |
| Acetone/Water 80/20 | 54.4 |
| Acetone 100% | 65.0 |

These results indicate that acetone is the best solvent for the removal of wood extractives from Lodgepole Pine. Acetone has advantages over the use of an 80/20 acetone/water mixture, and is also superior to the other solvents tested.

It is theorized, without being bound, that oxidized acids (or alkaline reagents), depend upon chemical reactions that convert wood resins in order to achieve extraction. Not only is this from a thermodynamic perspective not as effective as direct solution of the extractives in an organic solvent, but alkaline extractions have several disadvantages. These include the darkening of wood fibers which would result in higher fiber bleaching costs. Moreover, the nonselective nature of caustic treatments result in loss of yield. Also, caustic extracts are extremely toxic and costly to treat.

Example 2

Process Conditions for the Removal of Wood Extractives

A series of acetone extractions were conducted to determine conditions suited for the efficient removal of wood extractives. In each case, a 50 gram batch of oven dried wood chips was treated in a solvent:wood ratio of 4.0. The wood chip species evaluated were seven batches of Ponderosa Pine (PP) and four batches Douglas Fir (DF) along with a PP control. During the extraction processes, steam preheating time, acetone extraction time, and post-steaming times were varied. Steam was supplied at ambient pressure, and the extractions were carried out at ambient temperatures and pressures. In each case, the extracted wood chips were finally squeezed in a press at 1500 psi for 5 minutes. A modified TAPPI test method, T204 om-88, using diethyl ether as the extraction solvent, was used to determine the percentage of wood extractives removed from the samples. The results are shown in Table 2.

TABLE 2

| | Steam #1 | | | Extraction #1 | | Steam #2 | | | Extraction #2 | | Press | Extraction |
|---|---|---|---|---|---|---|---|---|---|---|---|---|
| | time, minutes | | | | | | | | | | | |
| | 0 | 15 | 30 | 15 | 30 | 0 | 15 | 30 | 15 | 30 | 5 | % |
| PP1 | | | | X | | | | | | | X | 62.5 |
| PP2 | | X | | X | | | | | | | X | 48.6 |
| PP3 | | X | | X | | | | | | | X | 53.3 |
| PP4 | | | | X | | | | | X | | X | 64.6 |
| PP5 | | X | | X | | | X | | X | | X | 58.5 |
| PP6 | | | | | X | | | | | X | X | 78.2 |
| PP7 | | | X | | X | | | X | | X | X | 73.0 |
| Control PP | | | | | $H_2O$ | | | | | | X | 17.6 |
| DF | | | | X | | | | | | | | 48.5 |
| DF | | | | X | | | | | | X | | 53.6 |
| DF | | X | | X | | | X | | X | | | 54.2 |
| DF | | | X | | X | | | X | | X | | 57.4 |

From the above table, presteaming with atmospheric steam did not appear to enhance extraction. Indeed, presteaming appears to reduce extraction. While multi-stage extractions show slight increases in overall extraction, this increase may not justify the additional equipment required in a commercial operation. Increasing the extraction time, in a single- or multiple-stage extraction, is effective in increasing the percent wood extractives removed.

Example 3

Variation of Percentage of Wood Extractives Removed With Extraction Time, Using Acetone as a Solvent A batch of Lodgepole Pine chips was sampled and tested as described in TAPPI T204 om-88, modified to use diethyl ether as a solvent, to ascertain the amount of wood extractives in the chips. Then, samples of the chips were each treated with acetone for 3, 5, 10, and 20 minutes, respectively. Each extracted chip sample was then air dried, ground to 1 mm size particulates, and extracted in the same modified TAPPI method to determine residual wood extractives. The percent wood extractives removed was calculated for each extracted sample and the results were tabulated in Table 3.

TABLE 3

| Time of Extraction (min) | Ether Extractables (wt. %) | Extraction (%) |
|---|---|---|
| 0 | 2.9 | 0 |
| 3 | 2.3 | 21 |
| 5 | 1.9 | 35 |
| 10 | 1.5 | 48 |
| 20 | 0.75 | 74 |

The results show that wood extractives were reduced from 2.9% in the raw Lodgepole Pine chips to 0.75 wt. % in 20 minutes. This represents an extraction of about 75% of the wood extractives. Moreover, after only 5 minutes, 35% of the wood extractives have been removed. Tests, based on heating the chips in a 105° C. oven for 24 hours and observing any weight loss, indicated that volatile organic compounds were virtually completely removed from the chips, even after only 5 minutes of extraction with acetone. Thus, longer extraction time are only needed if it is desired to remove increasing quantities of pitch.

It is theorized, without being bound, that lower molecular weight wood extractives are more soluble and are therefore extracted at a faster rate than the higher molecular weight components. Consequently, VOCs are first removed, followed by those wood extractives that are likely to become volatilized under wood chip pulping conditions, and composite board making conditions. Therefore, extraction need only proceed to remove these components, unless higher molecular weight, less soluble pitch must also be removed for other purposes.

Example 4

Determination of the Effect of Wood Particle Size and Handling Conditions on Removal of Wood Extractives In order to test the effect of particle size, wood chips were treated in equipment that would either (1) reduce average particle size or, (2) cause fractures in the wood chips opening internal surfaces and reducing average chip thickness. A batch of chips was treated with a Rader DynaYield Chip Conditioner, designed to squeeze those wood chips that have a thickness greater than 1.5 mm. In this conditioner, the greater the thickness of the charged wood chip, the more work is applied to the wood causing delamination along the wood grain. In effect, this reduces the apparent particle thickness without significantly decreasing chip size or integrity.

Another batch of chips was treated in a Prex screw press. This equipment causes a larger size reduction. However, it is also known that the quality of pulp produced from chips treated through a screw press, or like equipment, such as the Sprout-Bauer Pressifine, French Oil Press, and Prex screw is minimally affected.

A sample of the wood chips was extracted using TAPPI T204 om-88 test method, modified to use diethyl ether as a solvent, to determine the percent wood extractives present. Those chip batches treated in the Rader Chip Conditioner and the Prex screw feeder and a control batch were each separately extracted with acetone, under the same conditions of concentration, solvent:wood ratio, temperature and pressure. A sample of the extracted chips was again analyzed by the TAPPI method to determine residual wood extractives. The percentage of wood extractives removed was calculated. The results are shown in Table 4.

TABLE 4

| | % Extractives Removed | | |
|---|---|---|---|
| Wood Chip Size | Control Chip | Rader Conditioner | Prex Screw |
| Over Thick > 10 mm | 60 | 72 | — |
| <10 mm | 58 | 78 | 84 |
| <6 mm | 65 | 67 | 88 |
| Pins | 82 | — | — |
| Fines | 91 | — | — |

As shown in the table, treating chips in a Rader conditioner allows some increase in the removal of wood extractives, especially for larger size wood chips. This is to be expected, since fracturing the larger wood chips allows better penetration of the solvent into the interior of the chip.

The effect of increased extraction is even greater with chips treated with the Prex Screw equipment. Again, this is explained by the greater degree of size reduction and fracturing of the chips that is achieved with this equipment that facilitates penetration by the solvent into the chip and removal of wood extractives.

Example 5

Thermomechanical Refining of Extracted Wood Chips to Determine Mechanical Pulp Strengths Five 1.5 Kg batch sizes of wood chips were subjected to a solvent extraction process. The resulting extracted chips were then refined using a 12 inch Sprout Waldron laboratory refiner to produce a thermomechanical pulp for evaluation of its characteristics.

Two of the five chip batches were extracted using acetone as the extraction solvent in a 4:1 solvent:wood mass ratio. The extraction process consisted of a first steaming cycle of 30 minutes with atmospheric steam, a 30 minute extraction with acetone under ambient conditions, a second 30 minute steam cycle with atmospheric steam, and a 5 minute pressing at 400 psi. A third batch was extracted with acetone, but the chips were not pressed after extraction. The solvent was drained and the sample was air dried. A fourth chip batch was treated in the same manner as the first two, but the solvent was water. Finally, the fifth batch was not extracted and is a control. Samples of each of the batches were first tested for ether extractables, using test method TAPPI T204 om-88 (modified to use diethyl ether as a solvent) to determine initial wood extractives content. After extraction of the chips with acetone or water, as described above, the extracted chips were tested for residual wood extractives using the same TAPPI method. The percent wood extractives removed was calculated for each batch. The results are shown in Table 5A.

TABLE 5A

| Batch No. | Solvent | % Extraction |
|---|---|---|
| 1 | Acetone | 75.9 |
| 2 | Acetone | 74.3 |
| 3 | Acetone (w/o pressing) | 56.2 |
| 4 | Water | 1.4 |
| Control | Control | — |

As can be seen from Table 5A, batches 1 and 2, extracted with acetone, showed the greatest reduction in wood extractives.

After evaporating any residual acetone from the chips of batches one and two, by oven drying, the chips were remoisturized to simulate the chip moisture that would be encountered under commercial operating conditions. The remoisturized chips were then refined in the 12 inch Sprout Waldron refiner. Each batch (except batch No. 3) was passed through the refiner six times, in succession, to achieve a Canadian Standard Freeness (CSF) (TAPPI test T227 om-94) of about 150. The refiner plate gap was 0.012 on the first pass, 0.006 on the second pass, and 0.003 inches on all successive passes through the refiner. The CSF, energy input to achieve the CSF, and characteristics of the resultant fibers are reported in Table 5B.

TABLE 5B

| Test | Acetone #1 | Acetone #2 | Water | Control |
|---|---|---|---|---|
| CSF[1] | 151 | 165 | 161 | 160 |
| % Shives[2] | 0.92% | 1.39% | 0.59% | 1.45% |
| +12[3] | 0.2 | 0.2 | 0.1 | 0.1 |
| +28 | 21.5 | 22.1 | 19.7 | 17.0 |
| +48 | 25.1 | 25.3 | 25.9 | 25.1 |
| +100 | 16.5 | 15.8 | 17.5 | 18.2 |
| +200 | 10.0 | 9.8 | 11.2 | 12.3 |
| −200 | 26.7 | 26.8 | 25.6 | 27.3 |
| Energy[4] | 34.8 | 34.4 | 34.0 | 34.0 |

While the CSF varies from 151 to 165, the variation is relatively small and provides an approximately uniform basis for comparison between the samples of fibers. The acetone extracted batches, Batches 1 and 2, show minimal variation from the control. Energy usage is also approximately the same as for the control.

Standard TAPPI hand sheets were made (T205 om-88) with each of the pulps to conduct standard tests. Physical and optical properties of the pulps were tested and are reported in Table 5C below.

TABLE 5C

| Property | Units | TAPPI Test | Acetone #1 | Acetone #2 | Water | Control | Percent Change[1] |
|---|---|---|---|---|---|---|---|
| Density | $Kg/m^3$ | T220 om-88 | 372.6 | 380.0 | 384.4 | 357.0 | 5.4 |
| Burst Index | kN/g | T220 om-88 | 1.12 | 1.12 | 0.89 | 0.76 | 47.4 |
| Tear Index | mN* $m^2/g$ | T220 om-88 | 4.33 | 4.14 | 3.72 | 3.32 | 27.6 |
| Tensile Index | Nm/g | T494 om-88 | 26.0 | 24.0 | 20.5 | 18.3 | 36.3 |
| Scott Bond | $J/m^2$ | T541 om-89 | 149 | 153 | 151 | 121 | 24.8 |
| Porosity | sec/100 ml | T547 pm-88 | 37 | 36 | 27 | 23 | 58.7 |
| Smoothness | Sheffield | T538 om-88 | 188 | 193 | 210 | 232 | 17.9 |
| Stiffness | mg | T451 cm-84 | 191 | 175 | 163 | 168 | 8.9 |

TABLE 5C-continued

| Property | Units | TAPPI Test | Acetone #1 | Acetone #2 | Water | Control | Percent Change[1] |
|---|---|---|---|---|---|---|---|
| Brightness | ISO | T452 om-92 | 45.1 | 46.0 | 46.5 | 50.0 | −8.9 |
| Opacity | ISO | T525 om-91 | 97.4 | 97.2 | 97.1 | 97.1 | 0.2 |
| Stretch | % | T220 om-88 | 1.48 | 1.45 | 1.29 | 1.31 | 11.8 |
| Scattering Coefficient | $m^2$/Kg | T220 om-88 | 44.9 | 45.2 | 46.1 | 50.3 | −10.4 |
| Adsorption Coefficient | $m^2$/Kg | T220 om-88 | 6.4 | 6.0 | 5.7 | 5.2 | 19.2 |

[1]positive values represent quality improvements for Acetone extracted pulps of the invention versus Control Importantly, density and strength indicators such as burst index, tear index, tensile index, and Scott Bond increase significantly over the control. Similarly, porosity, measured as the number of seconds for 100 ml of air to pass through a measured area of paper, also increases significantly. This corroborates the increase in density. It is theorized, without being bound, that density and strength measurements increase due to better inter-fiber bonds as a result of the removal of a substantial proportion of the wood extractives (especially pitch and heavier components) that might interfere with inter-fiber bonding.

Whereas opacity did not appear to change significantly, the scattering coefficient showed a reduction. However, calculation of the opacity, normalized for the same brightness, suggests a decrease in opacity. The reduction of scattering coefficient is probably also the result of the significant increase in fiber-fiber bonding strength, demonstrated in the burst and tensile strength increases. While brightness appears to decrease, other tests indicate that extracted pulps of reduced VOC and pitch content have a more marked response to bleaching agents so that less bleaching agent is required to achieve a specific brightness.

Example 6

Pilot Plant Extraction and Refining of Wood Chips to Compare Optical Propertiese, Strengh and Volatile Organic Compound Emissions A pilot plant extractor, designed and operated by Crown Iron Works of Minneapolis, Minn., was employed to perform the extraction of wood particulates with a solvent. The extractor was a Model 5 Crown Iron Works extractor with a capacity to process 1,000 lbs. per day of oven-dried wood. This extractor uses the principle of solvent percolation to extract wood extractives from a bed of chips. Solvent is sprayed from above onto a 2 inch thick bed of chips as the bed of chips moves through a series of sequential compartments of the housing of the extractor. The chip bed rests on a screen, thereby allowing solvent to drain from the chips for collection in each segregated compartment. The collected solvent is pumped from one compartment to the next, in a counter current flow direction relative to the chips.

The chips were sized so that approximately 60% by weight had an average size of 2.5 cm. by 6 mm. thick. Two batches of wood chips were evaluated: (1) a 50/50 blend of Western Hemlock/Lodgepole Pine, and (2) Douglas Fir. Each batch of chips was subjected to a 30 minute soak time (residence time in the extractor) at a 4:1 solvent to wood mass ratio. The extraction was carried out under ambient conditions, approximately 70° F. (20° C.). After extraction, the chips were passed through an indirect heated drier, where heat was applied with 180° F. (82° C.) steam. The temperature at the drier outlet was 150° F. (65° C.), and the wood was dried to an approximate 8% moisture (volatile liquid weight) content. No residual acetone was detected in the dried wood. The results of the solvent extraction are summarized in Table 6A.

TABLE 6A

| | Solvent:Wood Mass Ratio | Extraction Time (mins) | Extraction Percentage |
|---|---|---|---|
| Hemlock/Lodgepole Pine, 50/50 blend | 4 to 1 | 30 | 46.2 |
| Douglas Fir | 4 to 1 | 30 | 50% |

The results indicate that from about 40 to about 50% of the wood extractives can be removed with the percolation extraction treatment at 70° F. (20° C.).

The dried extracted chips were then refined in a thermomechanical pulping system. The equipment included a Sprout-Bauer 36" Model CD-300 refiner. The primary stage of the refiner was pressurized to 30 psi, and the secondary refiner was operated under atmospheric conditions. The resulting thermomechanical pulps were evaluated for ether extractables. Based on this data, the overall VOC removal and emissions were estimated. These results are shown in Table 6B.

TABLE 6B

| | % Ether extractables | % loss | VOC emission lb/ton | % VOCs removed |
|---|---|---|---|---|
| Control chips | 2.45 | — | — | — |
| Primary Stage TMP (using control chips) | 0.84 | 1.61 | 32.2 | — |
| Acetone extracted chips | 0.71 | — | — | — |
| Primary Stage TMP (using extracted chips) | 0.55 | 0.16 | 3.2 | ~90 |

The results show that extracting 71% of ether extractables with acetone extraction resulted in a decrease of 90% in VOC emissions-from 32.2 lb/ton to only 3.2 lb/ton.

The pulps were all prepared to a Canadian Standard Freeness (CSF) of about 100. The pulps of each batch were made into TAPPI handsheets and tested for strength and optical properties. The results are shown in Table 6C.

TABLE 6C

| Property | Units | Control TMP | Treated TMP | % Change |
|---|---|---|---|---|
| Freeness (CSF) | ml | 100 | 100 | — |
| Specific Energy | kwh/ODMT | 2523 | 2661 | −6 |
| Burst Index | kPa $m^2$/g | 2.3 | 2.2 | −5 |
| Tensile Index | Nm/g | 42.4 | 41.2 | −3 |
| Tear Index | mN$m^2$/g | 97 | 11.0 | +13 |
| Pulmac Shives | % 0.1 mm | 2.99 | 3.13 | −4 |
| Long Fiber | % +28 Mesh | 36.9 | 37.5 | +2 |
| Brightness | ISO | 44.2 | 47.1 | +6 |
| Opacity | % | 97.4 | 96.9 | −0.5 |
| Scattering Coefficient | $m^2$/Kg | 52.4 | 51.1 | −3 |

Next, samples of each of the pulps were bleached with 1% and 3% hydrogen peroxide solutions, respectively. The resulting brightness was compared to the corresponding unbleached pulp, a control pulp, and an Impressifiner (alkaline/peroxide extracted) wood pulp, as shown in Table 6D.

TABLE 6D

| Sample | Raw Brightness | 1% Peroxide | 3% Peroxide | Change in Brightness | Brightness Gain vs. Control |
|---|---|---|---|---|---|
| Control | 38.2 | 41.5 | 49 | 11 | — |
| Acetone | 40.8 | 45 | 53 | 13 | +2 |
| Alkaline/ Peroxide | 44.2 | 44 | 49.5 | 5 | −6 |

The solvent extracted pulp showed a slight improvement in brightness response, as compared to the control pulps. This, coupled with the higher initial brightness of the solvent treated pulp, resulted in a 4 point gain in final brightness, after bleaching. In contrast, Impressifiner wood chips, extracted with alkaline/peroxide chemicals, were brighter, but showed lower gains in brightness upon bleaching.

Example 7

Commercial Pilot Plant Extraction of Wood Chips to Compare Brightness, Strength and VOCs The relatively low levels of removal of wood extractives in the first commercial trial (Example 6) prompted a second trial. In these tests, the chips were preconditioned through a Prex Screw chip press to open up internal surface area to allow more rapid solvent penetration for leaching wood extractives from the wood. Moreover, the chips were totally immersed in the solvent, rather than having the solvent percolate through a chip bed, to further assist penetration of solvent into the wood. The mass ratio of solvent to wood was 4:1, and the extraction was carried out at ambient temperature (about 26° C.) for about 30 minutes, with mild stirring at 5 minute intervals.

Oven dried batches of 300 lbs. (135 Kg) each of wood chips of three species were extracted: Hemlock, Lodgepole Pine, and Douglas Fir. To perform the extraction, each 300 lb. batch was divided into 35 lb. batches. After extraction, the chips were gravity drained for 10 minutes to remove the miscelia, then sealed in plastic bags for postpressing. Post-extraction pressing was carried out on an Anderson Screw Press at a volume compression ratio of about 4:1, leading to some reduction in wood particle size. The volume of pressate removed was about 10 to about 15% of that obtained from the extraction as a miscella. The chips were then dried at 200° F. (93° C.) to a moisture content of from about 2 to about 8%. The percent extractables removed in each step is shown in Table 7A.

TABLE 7A

| Wood Species/ Process Steps | Extraction by immersion | Post Pressing | Drying |
|---|---|---|---|
| Western Hemlock | 59% | 67% | 72% |
| Lodgepole Pine | 69% | 76% | 79% |
| Douglas Fir | 64% | 62% | 67% |
| Douglas Fir No Post Pressing | 67% | n.a. | 73% |

As can be seen from the results, immersion extraction, especially when combined with post pressing and drying, provides significant enhancement in extraction as compared to percolation extraction. Thus, from about 70 to about 80%. of the wood extractives can be removed.

After extraction and drying, the treated chips, and a control batch of chips, were separately refined in a Sprout-Bauer 36-inch TMP Refiner System, as in Example 6. Samples of chips fed to the primary refiner, and the pulp from the primary refiner, were analyzed for percent ether extractables. The net change in extractables represents possible VOC emission from this stage of the pulping process. Table 7B summarizes these results for each species and a blend.

TABLE 7B

| | % Extractives Average | % Loss | VOCs lbs./ton | % VOC Removed |
|---|---|---|---|---|
| Lodgepole Pine | | | | |
| Control Chip | 2.14 | | | |
| Control TMP | 1.42 | 0.72 | 14.4 | |
| Treated Chip | 0.33 | | | |
| Treated TMP | 0.33 | 0.00 | 0 | 100% |
| Hemlock | | | | |
| Control Chip | 0.44 | | | |
| Control TMP | 0.19 | 0.25 | 5.0 | |
| Treated Chip | 0.14 | | | |
| Treated TMP | 0.12 | 0.02 | 0.4 | 92% |
| Hemlock Pine Blend | | | | |
| Control Chip | 0.865 | | | |
| Control TMP | 0.45 | 0.45 | 9.0 | |
| Treated Chip | 0.22 | | | |
| Treated TMP | 0.2 | 0.02 | 0.4 | 96% |
| Douglas Fir | | | | |
| Control Chip | 0.54 | | | |
| Control TMP | 0.18 | 0.36 | 7.2 | |
| Treated Chip | 0.18 | | | |
| Treated TMP | 0.17 | 0.01 | 0.2 | 97% |

As can be seen from the above, about 100% of the VOCs can be extracted from Lodgepole Pine, while about 92% of the VOCs can be removed from Hemlock, using the process of the invention.

TAPPI hand sheets were made from each pulp produced. These pulps were tested for strength and optical properties. The results are summarized in Tables 7C–F, below.

TABLE 7C

Comparison of TMP Pulp Quality - Western Hemlock

| | Units | Treated | Control | Change |
|---|---|---|---|---|
| Freeness (CSF) | ml | 70 | 70 | |
| Bulk | $cm^3/g$ | 3.12 | 3.54 | |
| Pulmac Shives | % 0.1 mm | 0.7 | 0.6 | |
| Brightness (Unbleached) | ISO | 38 | 39 | |
| Opacity | % | 99.5 | 99.5 | |
| Burst Index | KPa $m^2/g$ | 2.13 | 1.73 | 24% |
| Tensile Index | Nm/g | 35.5 | 41.4 | 17% |
| Tear Index | mN $m^2/g$ | 7.21 | 6.9 | 4% |
| Breaking Length | km | 4.2 | 3.6 | 17% |
| Porosity | sec/100 mls | 172 | 170 | 1% |
| Stretch | % | 1.95 | 2.1 | −7% |
| Strength Factor | — | 98 | 89 | 10% |

TABLE 7D

Comparison of TMP Pulp Quality - Lodgepole Pine

| | Units | Treated | Control | Change |
|---|---|---|---|---|
| Freeness (CSF) | ml | 92 | 88 | |
| Bulk | $cm^3/g$ | 3.30 | 3.5 | |
| Pulmac Shives | % 0.1 mm | .8 | .65 | |
| Brightness (Unbleached) | ISO | 46 | 48 | |
| Opacity | % | — | 96 | |
| Burst Index | KPa $m^2/g$ | 2.07 | 1.62 | 28% |
| Tensile Index | Nm/g | 41.4 | 33.5 | 24% |
| Tear Index | mN $m^2/g$ | 9.34 | 7.92 | 18% |
| Breaking Length | km | 4.2 | 3.4 | 24% |
| Porosity | sec/100 mls | 80 | 105 | |
| Stretch | % | 1.9 | 1.75 | 9% |
| Strength Factor | — | 117 | 97 | 20% |

TABLE 7E

Comparison of TMP Pulp Quality - 70/30 Blend Western Hemlock/Lodgepole Pine

| | Units | Treated | Control | Change |
|---|---|---|---|---|
| Freeness (CSF) | ml | 82 | 78 | |
| Bulk | $cm^3/g$ | 3.30 | 3.40 | |
| Pulmac Shives | % 0.1 mm | 0.7 | 0.65 | |
| Brightness (Unbleached) | ISO | 38 | 42 | |
| Opacity | % | — | 98.5 | |
| Burst Index | KPa $m^2/g$ | 2.64 | 2.23 | 18% |
| Tensile Index | Nm/g | 43.3 | 40.4 | 7% |
| Tear Index | mN $m^2/g$ | 10.96 | 9.64 | 14% |
| Breaking Length | km | 4.4 | 4.1 | 7% |
| Porosity | sec/100 mls | 135 | 135 | 0% |
| Stretch | % | 1.43 | 1.84 | 22% |
| Strength Factor | — | 138 | 121 | 14% |

TABLE 7F

Comparison of TMP Pulp Quality - Douglas Fir

| | Units | Treated | Control | Change |
|---|---|---|---|---|
| Freeness (CSF) | ml | 107 | 101 | |
| Bulk | $cm^3/g$ | 3.33 | 3.45 | |
| Pulmac Shives | % 0.1 mm | 1.5 | 1.3 | |
| Brightness (Unbleached) | ISO | 41.4 | 43.6 | |
| Opacity | % | 99 | 97.5 | |
| Burst Index | KPa $m^2/g$ | 1.62 | 1.42 | 14% |
| Tensile Index | Nm/g | 21.0 | 20.2 | 4% |
| Tear Index | mN $m^2/g$ | 8.12 | 6.70 | 21% |
| Breaking Length | km | 2.13 | 2.05 | 4% |
| Porosity | sec/100 mls | 260 | 245 | 6% |
| Stretch | % | 1.54 | 1.48 | 4% |
| Strength Factor | — | 98 | 82 | 20% |

The results show a significant improvement in strength properties as compared to the control, and as compared to the TAPPI hand sheets of Example 6, made from pulps that were not extracted to the same extent.

Samples of each of the pulps were then bleached with a standard 3.0% hydrogen peroxide bleach solution at a 60 lbs./ton dosage rate (30 Kg per metric ton). The gain in brightness was observed for each sample, and the results were recorded in Table 7G.

TABLE 7G

Hydrogen Peroxide Bleaching of Treated TMP Pulps

| | TMP Brightness | | | |
|---|---|---|---|---|
| | Un-bleached | Bleached with 3% Peroxide | Differ-ence | Improvement |
| Hemlock Control | 39 | 47 | 8 | |
| Hemlock Treated | 38 | 48 | 10 | +2 |
| Lodgepole Pine Control | 48 | 52 | 4 | |
| Lodgepole Pine Treated | 46 | 53 | 7 | +3 |
| Douglas Fir Control | 43 | 46 | 3 | |
| Douglas Fir Treated | 41 | 47 | 6 | +3 |
| 70/30 Hemlock/Lodgepole Pine Blend Control | 42 | 48 | 6 | |
| 70/30 Hemlock/Lodgepole Pine Blend Treated | 38 | 48 | 10 | +4 |

In each case the pulp made in accordance with the invention, from solvent extracted chips, showed gains in brightness as compared to a control.

Example 8

Reduction of VOC Emissions and Pitch Fouling From a Chemical Pulping Process A chemical pulp mill is charged with control raw, unextracted, wood particulates to prepare a wood pulp, in accordance with the process explained above, with reference to FIG. 5. During this process VOCs are emitted from a blow tank receiving a digested pulp mass from the digester, and also from the brown stock washing process. The levels of VOC emissions are monitored and the total VOCs emitted per day is calculated. Moreover, the maximum output of the pulping process is achieved when the recovery boiler of the chemical reclaiming stage reaches a "solids limit". The maximum throughput of the pulping facility is recorded. The quantity of defoaming chemicals added in the washing step to depress foaming and facilitate washing is recorded. Also recorded is the amount of bleaching chemicals needed to bleach the pulp to a specific brightness. The amount of chemical reactants consumed in the digestion process per ton of chips processed is also recorded.

Wood chips, of the same species and containing the same quantity of naturally occurring pitch and VOCs are then subjected to an extraction procedure, as explained above, with reference to FIGS. 2 and 3A, using acetone as the solvent. The extracted wood particulates have a significantly lower concentration of wood extractives. In particular, the VOC content is reduced to virtually zero, and the pitch content is reduced by about 50%.

The extracted wood chips are now charged to the same chemical pulping process as the control chips, while maintaining operating conditions of temperature and pressure at substantially the same levels as for the control raw wood particulates. Once again, the pulp mass from the digester is debouched into the blow tank, except that the vapors emitted from the blow tank are substantially free of naturally-occurring VOCs. Moreover, when this pulp mass is washed on the rotary dryers, the washing operation is also substantially free of naturally-occurring VOC emissions.

Because of the removal of pitch from the wood particulates, less chemical reactants are consumed in the digestion process. As a result, the amount of black liquor that must be circulated to the chemical recovery stage is reduced. Consequently, the waste heat boiler of the chemical recovery stage no longer operates at its solids handling limit. Thus, the throughput of the chemical pulping process is increased until the solids limit is once again reached.

It is estimated that the removal of wood extractives from the wood particulates results in an increase in chip throughput of about 2% in the chemical pulping process, resulting in an about 2% increase in pulp produced, without additional expenditure for energy or chemicals. Indeed, digester chemical consumption decreases by about 2–3% because of the removal of pitch, that tends to react with process chemicals, from the particulates. The amount of bleaching chemicals to achieve the specified brightness is also reduced because of the removal of pitch and an observed enhanced brightness response to bleaching. Moreover, a significant reduction in defoaming chemicals required is also observed due to the removal of saponifiable extractives from the wood chips.

Finally, a comparison of the liquid absorbence of products made with the control pulp with the product of the invention demonstrates that the invention product has increased absorbence.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A reduced VOC-emissions process for producing a wood pulp comprised of wood fibers from wood particulates comprising wood fibers, pitch, and volatile organic compounds, the process comprising:

(a) contacting wood particulates, containing naturally-occurring pitch and naturally-occurring volatile organic compounds, with an extraction solvent for the pitch and the volatile organic compounds to extract at least a portion of the pitch and a portion of the volatile organic compounds from the wood particulate into the solvent, under a pressure less than 50 psi without significant dissolution of lignin and cellulosic components of the wood, to produce extracted particulates, the solvent of the solvent extraction process being recovered and recycled for reuse, said solvent being selected from the group consisting of methanol, ethanol and acetone;

(b) mechanically fiberizing the solvent-extracted wood particulates; and (c) producing a wood pulp comprising wood fibers and lignin wherein the fiberizing and the producing steps have significantly reduced emissions of naturally-occurring volatile organic compounds, as compared to emissions from fiberizing and producing a wood pulp from wood particulates containing naturally-occurring levels of volatile organic compounds.

2. The process of claim 1, wherein from about 40 to about 80% of the pitch of the wood particulates is removed.

3. The process of claim 1, wherein from about 50 to about 100% of the volatile organic compounds are removed from the wood particulates.

4. The process of claim 1, wherein the step of fiberizing is carried out in a series of at least two refiners.

5. The process of claim 1, further comprising heating the wood particulates before the step of fiberizing.

6. The process of claim 1, further comprising:

screening the fiberized product of step (b) to separate oversized particles; and recycling oversized particles for further fiberizing.

7. The process of claim 1, further comprising bleaching the wood pulp produced in the fiberizing step, the bleaching process having substantially reduced volatile organic compound emissions as compared to bleaching wood pulp produced from wood containing naturally-occurring levels of volatile organic compounds.

8. A process of reduced VOC-emissions for producing a pumpable, reduced pitch-content fibrous pulp from wood particulates containing pitch and volatile organic compounds, the process comprising:

(a) contacting wood particulates with an organic solvent for wood extractives to leach wood extractives from the wood particulates into the solvent under a pressure of less than 50 psi without significant removal of lignin to produce (1) leached wood particulates having a substantially reduced volatile organic compound content, and a substantially reduced pitch content, and (2) a miscella comprising solvent and wood extractives, the miscella treated to reclaim solvent for recycling to leach wood particulates, said solvent being selected from the group consisting of methanol, ethanol and acetone;

(b) separating the leached wood particulates from the miscella;

(c) fiberizing the leached wood particulates, the fiberizing step having substantially reduced volatile organic compound emissions as compared to defiberizing wood particulates containing naturally-occurring levels of volatile organic compounds; and (d) adding water to the fiberized wood particulates to produce a pumpable fibrous pulp, the pulp having lignin and a reduced pitch content as compared to pulps produced from wood particulates containing naturally-occurring levels of pitch.

9. The process of claim 8, further comprising:

reclaiming solvent from the separated miscella; and recycling the solvent for leaching wood extractives from wood particulates.

10. The process of claim 9, wherein the solvent is miscible in water.

11. The process of claim 9, wherein the solvent is acetone and at least about 95% of the solvent is recycled.

12. The process of claim 1, wherein the fiberizing is carried on in a series of at least two sequential refiners.

13. The process of claim 12, further comprising:

screening fibers produced by the fiberizing of step (c); and recycling separated oversized particulates for further fiberizing.

14. The process of claim 8, further comprising bleaching wood fibers produced in the fiberizing step, the bleaching step having substantially reduced volatile organic compound emissions as compared to bleaching wood produced from wood pulp containing naturally-occurring levels of volatile organic compounds.

15. The process of claim 8, further comprising heating the wood particulates before the step of fiberizing.

* * * * *